US008687829B2

(12) United States Patent
Hilpert et al.

(10) Patent No.: US 8,687,829 B2
(45) Date of Patent: Apr. 1, 2014

(54) APPARATUS AND METHOD FOR MULTI-CHANNEL PARAMETER TRANSFORMATION

(75) Inventors: Johannes Hilpert, Nuremburg (DE); Karsten Linzmeier, Erlangen (DE); Juergen Herre, Buckenhof (DE); Ralph Sperschneider, Ebermannstadt (DE); Andreas Hoelzer, Erlangen (DE); Lars Villemoes, Jaerfaella (DE); Jonas Engdegard, Stockholm (SE); Heiko Purnhagen, Sundbyberg (SE); Kristofer Kjoerling, Solna (SE); Dirk Jeroen Breebaart, Eindhoven (NL); Werner Oomen, Eindhoven (NL)

(73) Assignees: Fraunhofer-Gesellschaft zur Foerderung der Angewandten Forschung E.V., Munich (DE); Dolby Sweden AB, Stockholm (SE); Koninklijke Philips Electronics N.V., Eindhoven (NL)

( * ) Notice: Subject to any disclaimer, the term of this patent is extended or adjusted under 35 U.S.C. 154(b) by 786 days.

(21) Appl. No.: 12/445,699

(22) PCT Filed: Oct. 5, 2007

(86) PCT No.: PCT/EP2007/008682

§ 371 (c)(1),
(2), (4) Date: Oct. 5, 2010

(87) PCT Pub. No.: WO2008/046530

PCT Pub. Date: Apr. 24, 2008

(65) Prior Publication Data

US 2011/0013790 A1 Jan. 20, 2011

Related U.S. Application Data

(60) Provisional application No. 60/829,653, filed on Oct. 16, 2006.

(51) Int. Cl.
*H04R 5/02* (2006.01)

(52) U.S. Cl.
USPC ..... 381/300; 381/1; 381/18; 381/20; 381/23; 381/22; 381/61; 381/63; 381/58; 381/119; 704/200.1; 704/219; 704/230; 704/500; 704/501; 704/502; 704/503; 704/504; 704/225; 704/201; 700/94

(58) Field of Classification Search
USPC ..... 381/1, 300, 18, 20, 23, 25, 61, 63, 58, 381/119, 22; 704/200.1, 219, 230, 704/500–504, 225, 201; 700/94
See application file for complete search history.

(56) References Cited

U.S. PATENT DOCUMENTS 5,761,634 A 6/1998 Stewart et al.
5,912,976 A 6/1999 Klayman et al.

(Continued)

FOREIGN PATENT DOCUMENTS

AU 2007312598 B2 10/2007
EP 0951021 A2 10/1999

(Continued)

OTHER PUBLICATIONS

PUlkki, Compensating displacement of amplitude-panned virtual sources, AES, 2002.*

(Continued)

*Primary Examiner* — Mohammad Islam
*Assistant Examiner* — Kuassi Ganmavo
(74) *Attorney, Agent, or Firm* — Michael A. Glenn; Perkins Coie LLP

(57) ABSTRACT

A parameter transformer generates level parameters, indicating an energy relation between a first and a second audio channel of a multi-channel audio signal associated to a multi-channel loudspeaker configuration. The level parameter are generated based on object parameters for a plurality of audio objects associated to a down-mix channel, which is generated using object audio signals associated to the audio objects. The object parameters have an energy parameter indicating an energy of the object audio signal. To derive the coherence and the level parameters, a parameter generator is used, which combines the energy parameter and object rendering parameters, which depend on a desired rendering configuration.

26 Claims, 8 Drawing Sheets

(56) References Cited

U.S. PATENT DOCUMENTS

| | | | | |
|---|---|---|---|---|
| 7,447,629 | B2 | 11/2008 | Breebaart | |
| 7,555,009 | B2 | 6/2009 | Oshima | |
| 7,761,177 | B2 * | 7/2010 | Oh et al. | 700/94 |
| 7,797,163 | B2 * | 9/2010 | Pang et al. | 704/500 |
| 7,961,890 | B2 * | 6/2011 | Holzer et al. | 381/23 |
| 7,965,848 | B2 * | 6/2011 | Villemoes et al. | 381/22 |
| 7,986,789 | B2 * | 7/2011 | Purnhagen et al. | 381/23 |
| 8,213,641 | B2 | 7/2012 | Faller et al. | |
| 8,214,221 | B2 * | 7/2012 | Pang et al. | 704/500 |
| 8,379,868 | B2 * | 2/2013 | Goodwin et al. | 381/17 |
| 2005/0022841 | A1 * | 2/2005 | Wittebrood | 134/6 |
| 2005/0074127 | A1 | 4/2005 | Herre et al. | |
| 2005/0177360 | A1 | 8/2005 | Schuijers et al. | |
| 2005/0195981 | A1 | 9/2005 | Faller et al. | |
| 2006/0009225 | A1 | 1/2006 | Herre et al. | |
| 2006/0100809 | A1 | 5/2006 | Yoneda | |
| 2006/0165237 | A1 | 7/2006 | Villemoes et al. | |
| 2006/0190247 | A1 | 8/2006 | Lindblom | |
| 2006/0235679 | A1 * | 10/2006 | Sperschneider et al. | 704/206 |
| 2007/0002971 | A1 | 1/2007 | Purnhagen et al. | |
| 2007/0055510 | A1 * | 3/2007 | Hilpert et al. | 704/230 |
| 2007/0071247 | A1 * | 3/2007 | Pang et al. | 381/20 |
| 2008/0008323 | A1 | 1/2008 | Hilpert et al. | |
| 2008/0140426 | A1 | 6/2008 | Kim et al. | |
| 2008/0255857 | A1 * | 10/2008 | Pang et al. | 704/500 |
| 2008/0319765 | A1 * | 12/2008 | Oh et al. | 704/500 |
| 2009/0006106 | A1 * | 1/2009 | Pang et al. | 704/500 |
| 2009/0110203 | A1 * | 4/2009 | Taleb | 381/17 |
| 2009/0144063 | A1 * | 6/2009 | Beack et al. | 704/500 |
| 2009/0164222 | A1 | 6/2009 | Kim et al. | |
| 2009/0177479 | A1 | 7/2009 | Yoon et al. | |
| 2009/0182564 | A1 * | 7/2009 | Beack et al. | 704/500 |
| 2010/0153097 | A1 | 6/2010 | Hotho et al. | |

FOREIGN PATENT DOCUMENTS

| | | | |
|---|---|---|---|
| EP | 1376538 | A1 | 1/2004 |
| EP | 1691348 | A1 | 8/2006 |
| EP | 1984916 | A1 | 8/2007 |
| EP | 1853092 | | 11/2007 |
| EP | 2100297 | A1 | 4/2008 |
| JP | 2002511683 | | 4/2002 |
| JP | 2002369152 | | 12/2002 |
| JP | 20046031 | | 1/2004 |
| JP | 2004193877 | | 7/2004 |
| JP | 200593058 | | 4/2005 |
| JP | 2005-151129 | | 6/2005 |
| JP | 2006101248 | | 4/2006 |
| JP | 2008517337 | | 5/2008 |
| JP | 2010-505328 | | 2/2010 |
| RU | 2129737 | | 4/1999 |
| RU | 2005104123 | A | 5/2008 |
| RU | 2363116 | | 7/2009 |
| RU | 2005103637 | A | 7/2009 |
| TW | 200611241 | A | 8/1994 |
| TW | 20061226041 | | 4/2006 |
| TW | 2006627380 | A | 7/2006 |
| WO | WO 99/52326 | | 10/1999 |
| WO | WO2004086817 | | 10/2004 |
| WO | WO2005/098826 | A1 | 10/2005 |
| WO | WO 2006/048203 | | 5/2006 |
| WO | WO2006/060279 | | 6/2006 |
| WO | WO 2006/084916 | A2 | 8/2006 |

OTHER PUBLICATIONS

Jang, Inseon et al.; "Low-bitrate multichannel audio coding"; 2005; Journal of Broadcast Engineering; The Korean Society of Broadcast Engineers, vol. 10, pp. 328-339.

Office Action mailed Nov. 9, 2010 in related Korean Patent Application No. 10-2009-7007754, 5 pages.

"Concepts of Object-Oriented Spatial Audio Coding", ISO/IEC JTC 1/SC 29/WG 11 N8329, Klagenfurt, Austria, Jul. 2006, 8 pages.

"WD on ISO/IEC 23003:2:200x, SAOC text and reference software", ISO/IEC JTC 1/SC 29/WG11 N9517, Shenzhen, China, Oct. 2007, 80 pages.

Engdegard, et al., "CT/Fraunhofer IIS/Philips Submission to the SAOC CfP", ISO/IEC JTC1/SC29/WG11, MPEG2007/M14696, Lausanne, CH, Jul. 2007, 14 pages.

Faller, C. et al; "Binaural Cue Coding Applied to Audio Compression with Flexible Rendering"; Oct. 2002; AES 113th Convention, LA CA Preprint 5686.

Faller, C.; "Parametric Joint-Coding of Audio Sources"; May 20-23, 2006; Convention Paper 6752 presented at the 120th AES Convention, Paris, France.

Faller, C. et al.; "Efficient representation of spatial audio using perceptual parametrization"; Oct. 2001; IEEE WASPAA, Mohonk, NY.

Baumgarte, F. et al.; "Estimation of auditory spatial cues for binaural cue coding"; May 2002; ICASSP, Orlando, Florida.

Faller, C. et al.; "Binaural cue coding: a novel and efficient representation of spatial audio"; May 2002; ICASSP; Orlando, Florida.

Faller, C. et al.; "Binaural cue coding applied to stereo and multichannel audio compression"; May 2002; AES 112th Convention, Munich Germany, Preprint 5574.

Faller, C. et al.; "Binaural Cue Coding—Part II: Schemes and applications"; Nov. 2003, IEEE Trans. on Speech and Audio Proc., vol. 11, No. 6.

Breebaart, J. et al.; "High-Quality Parametric Spatial Audio Coding at Low Bitrates"; May 2004; AES 16th Convention; Berlin, Germany, Preprint 6072.

Schuijers, E. et al.; "Low Complexity Parametric Stereo Coding"; May 2004; AES 116th Convention, Berlin, Germany, Preprint 6073.

ISO/IEC JTC1/SC29/WG11 (MPEG), Document N8324, "Text of ISO/IEC FDIS 23003-1:2006, MPEG Surround"; Jul. 2006; Klagenfurt, Austria.

Pulkki, V.; "Spatial Sound Generation and Perception by Amplitude Panning Techniques"; 2001; Helsinki University of Technology, Helsinki, Finland.

Recommendation ITU-R BS. 775-1, "Multichannel Stereophonic Sound System With and Without Accompanying Picture"; 1992-1994.

Villemoes, L. et al.; "MPEG Surround: The Forthcoming ISO Standard for Spatial Audio Coding"; Jun. 30-Jul. 2, 2006; 28th International AES Conference, The Future of Audio Technology Surround and Beyond, Pitea, SE.

Breebaart, J. et al.; "Multi-Channel goes Mobile: MPEG Surround Binaural Rendering"; Sep. 2-4, 2006; 29th International AES Conference, Audio for Mobile and Handheld Devices, Seoul.

Faller, C.; "Parametric Joint-Coding of Audio Sources"; May 20-23, 2006; AES 120th Convention, Paris France, Convention Paper 6752.

Herre, et al.; "The Reference Model Architecture for MPEG Spatial Audio Coding"; May 28, 2005; Audio Engineering Society Convention paper, New York, NY pp. 1-13.

Breebaart, et al.; "MPEG spatial audio coding/MPEG surround: Overview and current status"; Oct. 7, 2005; Audio Engineering Society Convention Paper, New York, NY, pp. 1-15 XP002364486 ,pp. 1-6.

International Organization for Standardization "Concepts of Object-Oriented Spatial Audio Coding"; Jul. 21, 2006; Video Standards and Drafts; XP030014821.

Herre, et al.; "Thoughts on an SAOC Architecture"; Oct. 18, 2006; Video Standards and Drafts, No. M13935, XP030042603.

ISO/IEC 23003-1:2006/FDIS, "Information technology—MPEG audio technologies—Part 1: MPEG Surround"; Jul. 21, 2006, XP030014816, pp. 79-81 and pp. 253-257.

* cited by examiner

APPARATUS AND METHOD FOR MULTI-CHANNEL PARAMETER TRANSFORMATION

CROSS-REFERENCE TO RELATED APPLICATIONS

This application is a U.S. national entry of PCT Patent Application Serial No. PCT/EP2007/008682 filed 5 Oct. 2007, and claims priority to U.S. Patent Application No. 60/829,653 filed 16 Oct. 2006, each of which is incorporated herein by reference.

BACKGROUND OF THE INVENTION

The present invention relates to a transformation of multi-channel parameters, and in particular to the generation of coherence parameters and level parameters, which indicate spatial properties between two audio signals, based on an object-parameter based representation of a spatial audio scene.

There are several approaches for parametric coding of multi-channel audio signals, such as 'Parametric Stereo (PS)', 'Binaural Cue Coding (BCC) for Natural Rendering' and 'MPEG Surround', which aim at representing a multi-channel audio signal by means of a down-mix signal (which could be either monophonic or comprise several channels) and parametric side information ('spatial cues') characterizing its perceived spatial sound stage.

Those techniques could be called channel-based, i.e. the techniques try to transmit a multi-channel signal already present or generated in a bitrate-efficient manner. That is, a spatial audio scene is mixed to a predetermined number of channels before transmission of the signal to match a predetermined loudspeaker set-up and those techniques aim at the compression of the audio channels associated to the individual loudspeakers.

The parametric coding techniques rely on a down-mix channel carrying audio content together with parameters, which describe the spatial properties of the original spatial audio scene and which are used on the receiving side to reconstruct the multi-channel signal or the spatial audio scene.

A closely related group of techniques, e.g. 'BCC for Flexible Rendering', are designed for efficient coding of individual audio objects rather than channels of the same multi-channel signal for the sake of interactively rendering them to arbitrary spatial positions and independently amplifying or suppressing single objects without any a priori encoder knowledge thereof. In contrast to common parametric multi-channel audio coding techniques (which convey a given set of audio channel signals from an encoder to a decoder), such object coding techniques allow rendering of the decoded objects to any reproduction setup, i.e. the user on the decoding side is free to choose a reproduction setup (e.g. stereo, 5.1 surround) according to his preference.

Following the object coding concept, parameters can be defined, which identify the position of an audio object in space, to allow for flexible rendering on the receiving side. Rendering at the receiving side has the advantage, that even non-ideal loudspeaker set-ups or arbitrary loudspeaker set-ups can be used to reproduce the spatial audio scene with high quality. In addition, an audio signal, such as, for example, a down-mix of the audio channels associated with the individual objects, has to be transmitted, which is the basis for the reproduction on the receiving side.

Both discussed approaches rely on a multi-channel speaker set-up at the receiving side, to allow for a high-quality reproduction of the spatial impression of the original spatial audio scene.

As previously outlined, there are several state-of-the-art techniques for parametric coding of multi-channel audio signals which are capable of reproducing a spatial sound image, which is—dependent on the available data rate—more or less similar to that of the original multi-channel audio content.

However, given some pre-coded audio material (i.e. spatial sound described by a given number of reproduction channel signals), such a codec does not offer any means for a-posteriori and interactive rendering of single audio objects according to the liking of the listener. On the other hand, there are spatial audio object coding techniques which are specially designed for the latter purpose, but since the parametric representations used in such systems are different from those for multi-channel audio signals, separate decoders are needed in case one wants to benefit from both techniques in parallel. The drawback that results from this situation is that, although the back-ends of both systems fulfill the same task, which is rendering of spatial audio scenes on a given loudspeaker setup, they have to be implemented redundantly, i.e. two separate decoders are necessitated to provide both functionalities.

Another limitation of the prior-art object coding technology is the lack of a means for storing and/or transmitting pre-rendered spatial audio object scenes in a backwards compatible way. The feature of enabling interactive positioning of single audio objects provided by the spatial audio object coding paradigm turns out to be a drawback when it comes to identical reproduction of a readily rendered audio scene.

Summarizing, one is confronted with the unfortunate situation that, although a multi-channel playback environment may be present which implements one of the above approaches, a further playback environment may be necessitated to also implement the second approach. It may be noted, that according to the longer history, channel-based coding schemes are much more common, such as, for example, the famous 5.1 or 7.1/7.2 multi-channel signals stored on DVD or the like.

That is, even if a multi-channel audio decoder and associated playback equipment (amplifier stages and loudspeakers) are present, a user needs an additional complete set-up, i.e. at least an audio decoder, when he wants to play back object-based coded audio data. Normally, the multi-channel audio decoders are directly associated to the amplifier stages and a user does not have direct access to the amplifier stages used for driving the loudspeakers. This is, for example, the case in most of the commonly available multi-channel audio or multimedia receivers. Based on existing consumer electronics, a user desiring to be able to listen to audio content encoded with both approaches would even need a complete second set of amplifiers, which is, of course, an unsatisfying situation.

SUMMARY

According to an embodiment, a multi-channel parameter transformer for generating a level parameter indicating an energy relation between a first audio signal and a second audio signal of a representation of a multi-channel spatial audio signal, may have an object parameter provider for providing object parameters for a plurality of audio objects associated to a down-mix channel depending on the object audio signals associated to the audio objects, the object parameters having an energy parameter for each audio object indicating an energy information of the object audio signal; and a parameter generator for deriving the level parameter by combining the energy parameters and object rendering parameters related to a rendering configuration.

According to another embodiment, a method for generating a level parameter indicating an energy relation between a first audio signal and a second audio signal of a representation of a multi-channel spatial audio signal, may have the steps of providing object parameters for a plurality of audio objects associated to a down-mix channel depending on the object audio signals associated to the audio objects, the object parameters having an energy parameter for each audio object indicating an energy information of the object audio signal; and deriving the level parameter by combining the energy parameters and object rendering parameters related to a rendering configuration.

According to another embodiment, a computer program may have a program code for performing, when running on a computer, a method for generating a level parameter indicating an energy relation between a first audio signal and a second audio signal of a representation of a multi-channel spatial audio signal, which may have the steps of: providing object parameters for a plurality of audio objects associated to a down-mix channel depending on the object audio signals associated to the audio objects, the object parameters having an energy parameter for each audio object indicating an energy information of the object audio signal; and deriving the level parameter by combining the energy parameters and object rendering parameters related to a rendering configuration.

It is therefore desirable to be able to provide a method to reduce the complexity of systems, which are capable of both decoding of parametric multi-channel audio streams as well as parametrically coded spatial audio object streams.

An embodiment of the invention is a multi-channel parameter transformer for generating a level parameter indicating an energy relation between a first audio signal and a second audio signal of a representation of a multi-channel spatial audio signal, comprising: an object parameter provider for providing object parameters for a plurality of audio objects associated to a down-mix channel depending on the object audio signals associated to the audio objects, the object parameters comprising an energy parameter for each audio object indicating an energy information of the object audio signal; and a parameter generator for deriving the level parameter by combining the energy parameters and object rendering parameters related to a rendering configuration.

According to a further embodiment of the present invention, the parameter transformer generates a coherence parameter and a level parameter, indicating a correlation or coherence and an energy relation between a first and a second audio signal of a multi-channel audio signal associated to a multi-channel loudspeaker configuration. The correlation- and level parameters are generated based on provided object parameters for at least one audio object associated to a down-mix channel, which is itself generated using an object audio signal associated to the audio object, wherein the object parameters comprise an energy parameter indicating an energy of the object audio signal. To derive the coherence and the level parameter, a parameter generator is used, which combines the energy parameter and additional object rendering parameters, which are influenced by a playback configuration. According to some embodiments, the object rendering parameters comprise loudspeaker parameters indicating the location of the playback loudspeakers with respect to a listening position. According to some embodiments, the object rendering parameters comprise object location parameters indicating the location of the objects with respect to a listening position. To this end, the parameter generator takes advantage of synergy effects resulting from both spatial audio coding paradigms.

According to a further embodiment of the present invention, the multi-channel parameter transformer is operative to derive MPEG Surround compliant coherence and level parameters (ICC and CLD), which can furthermore be used to steer an MPEG Surround decoder. It is noted that Inter-channel coherence/cross-correlation (ICC)-represents the coherence or cross-correlation between the two input channels. When time differences are not included, coherence and correlation are the same. Stated differently, both terms point to the same characteristic, when inter channel time differences or inter channel phase differences are not used.

In this way, a multi-channel parameter transformer together with a standard MPEG Surround-transformer can be used to reproduce an object-based encoded audio signal. This has the advantage, that only an additional parameter transformer is necessitated, which receives a spatial audio object coded (SAOC) audio signal and which transforms the object parameters such, that they can be used by a standard MPEG SURROUND-decoder to reproduce the multi-channel audio signal via the existing playback equipment. Therefore, common playback equipment can be used without major modifications to also reproduce spatial audio object coded content.

According to a further embodiment of the present invention, the generated coherence and level parameters are multiplexed with the associated down-mix channel into a MPEG SURROUND compliant bitstream. Such a bitstream can then be fed to a standard MPEG SURROUND-decoder without requiring any further modifications to the existing playback environment.

According to a further embodiment of the present invention, the generated coherence and level parameters are directly transmitted to a slightly modified MPEG Surround-decoder, such that the computational complexity of a multi-channel parameter transformer can be kept low.

According to a further embodiment of the present invention, the generated multi-channel parameters (coherence parameter and level parameter) are stored after the generation, such that a multi-channel parameter transformer can also be used as a means for preserving the spatial information gained during scene rendering. Such scene rendering can, for example, also be performed at the music-studio while generating the signals, such that a multi-channel compatible signal can be generated without any additional effort, using a multi-channel parameter transformer as described in more detail in the following paragraphs. Thus, pre-rendered scenes could be reproduced using legacy equipment.

BRIEF DESCRIPTION OF THE DRAWINGS

Prior to a more detailed description of several embodiments of the present invention, a short review of the multi-channel audio coding and object audio coding techniques and spatial audio object coding techniques will be given. To this end, reference will also be made to the enclosed Figures.

DETAILED DESCRIPTION OF THE INVENTION

Figure 1A:
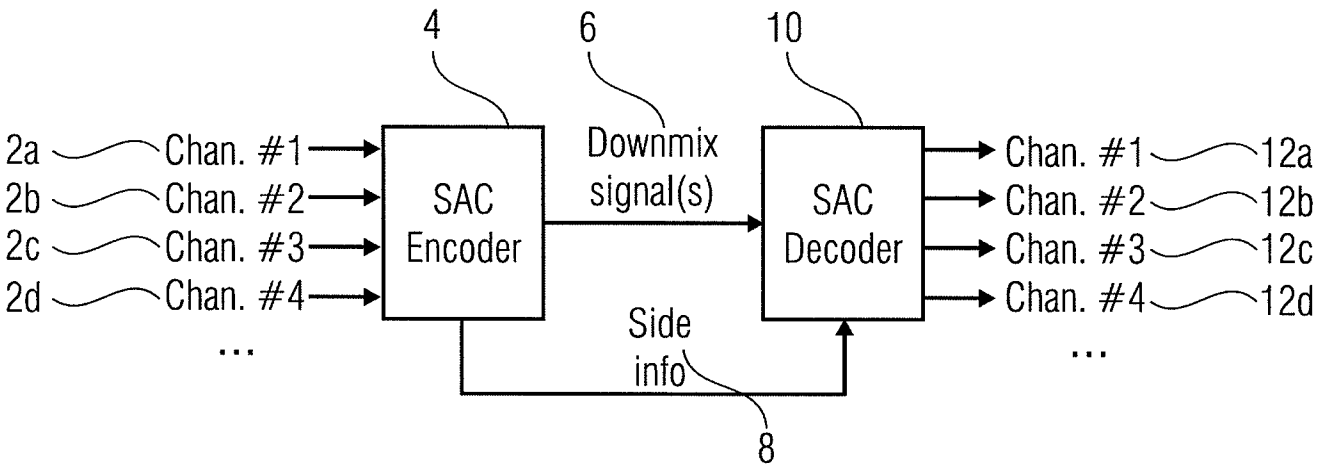
FIG. 1*a* shows a prior art multi-channel audio coding scheme.
Figure 1B:
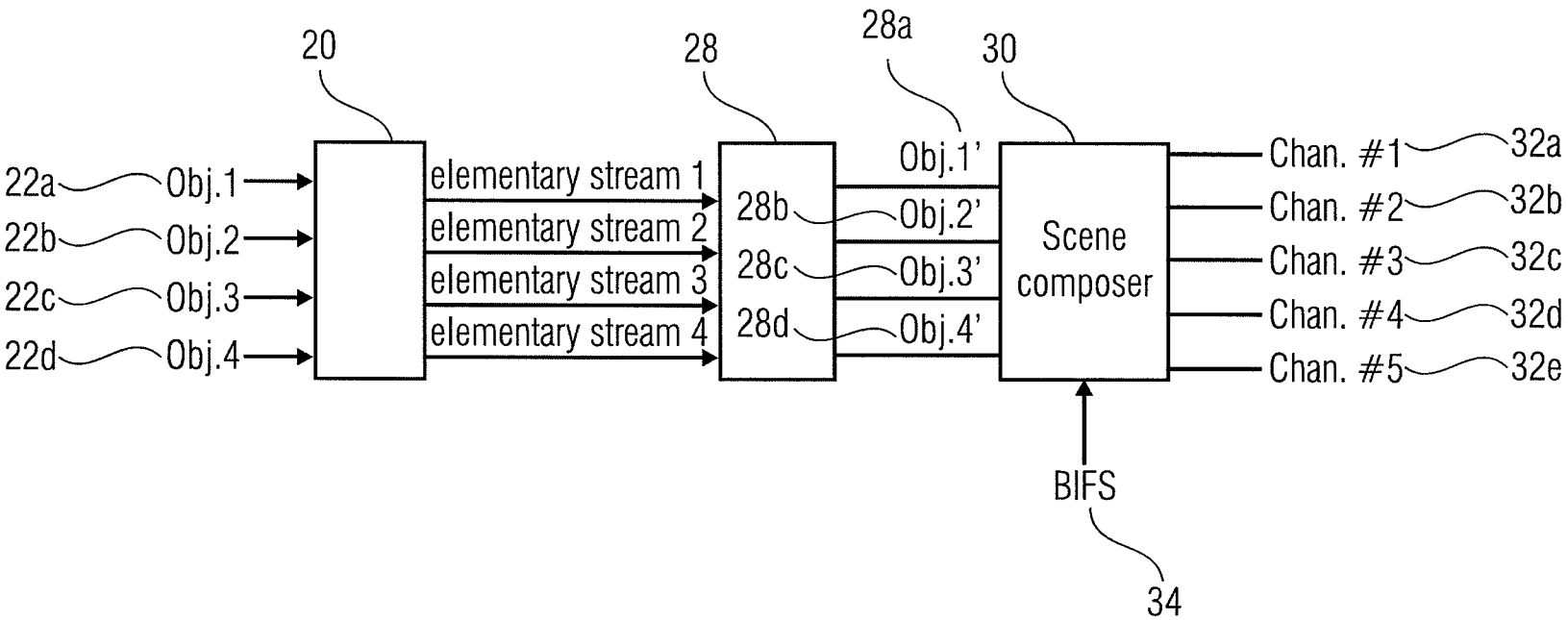
FIG. 1*b* shows a prior art object coding scheme.

FIG. 1*a* shows a schematic view of a multi-channel audio encoding and decoding scheme, whereas FIG. 1*b* shows a schematic view of a conventional audio object coding scheme. The multi-channel coding scheme uses a number of provided audio channels, i.e. audio channels already mixed to fit a predetermined number of loudspeakers. A multi-channel encoder 4 (SAC) generates a down-mix signal 6, being an audio signal generated using audio channels 2*a* to 2*d*. This down-mix signal 6 can, for example, be a monophonic audio channel or two audio channels, i.e. a stereo signal. To partly compensate for the loss of information during the down-mix, the multi-channel encoder extracts multi-channel parameters, which describe the spatial interrelation of the signals of the audio channels 2*a* to 2*d*. This information is transmitted, together with the down-mix signal 6, as so-called side information 8 to a multi-channel decoder 10. The multi-channel decoder 10 utilizes the multi-channel parameters of the side information 8 to create channels 12*a* to 12*d* with the aim of reconstructing channels 2*a* to 2*d* as precisely as possible. This can, for example, be achieved by transmitting level parameters and correlation parameters, which describe an energy relation between individual channel pairs of the original audio channels 2*a* and 2*d* and which provide a correlation measure between pairs of channels of the audio channels 2*a* to 2*d*.

When decoding, this information can be used to redistribute the audio channels comprised in the down-mix signal to the reconstructed audio channels 12*a* to 12*d*. It may be noted, that the generic multi-channel audio scheme is implemented to reproduce the same number of reconstructed channels 12*a* to 12*d* as the number of original audio channels 2*a* to 2*d* input into the multi-channel audio encoder 4. However, other decoding schemes can also be implemented, reproducing more or less channels than the number of the original audio channels 2*a* to 2*d*.

In a way, the multi-channel audio techniques schematically sketched in FIG. 1*a* (for example the recently standardized MPEG spatial audio coding scheme, i.e. MPEG Surround) can be understood as bitrate-efficient and compatible extension of existing audio distribution infrastructure towards multi-channel audio/surround sound.

FIG. 1*b* details the prior art approach to object-based audio coding. As an example, coding of sound objects and the ability of "content-based interactivity" is part of the MPEG-4 concept. The conventional audio object coding technique schematically sketched in FIG. 1*b* follows a different approach, as it does not try to transmit a number of already existing audio channels but to rather transmit a complete audio scene having multiple audio objects 22*a* to 22*d* distributed in space. To this end, a conventional audio object coder 20 is used to code multiple audio objects 22*a* to 22*d* into elementary streams 24*a* to 24*d*, each audio object having an associated elementary stream. The audio objects 22*a* to 22*d* (sound sources) can, for example, be represented by a monophonic audio channel and associated energy parameters, indicating the relative level of the audio object with respect to the remaining audio objects in the scene. Of course, in a more sophisticated implementation, the audio objects are not limited to be represented by monophonic audio channels. Instead, for example, stereo audio objects or multi-channel audio objects may be encoded.

A conventional audio object decoder 28 aims at reproducing the audio objects 22*a* to 22*d*, to derive reconstructed audio objects 28*a* to 28*d*. A scene composer 30 within a conventional audio object decoder allows for a discrete positioning of the reconstructed audio objects 28*a* to 28*d* (sources) and the adaptation to various loudspeakers set-ups. A scene is fully defined by a scene description 34 and associated audio objects. Some conventional scene composers 30 expect a scene description in a standardized language, e.g. BIFS (binary format for scene description). On the decoder side, arbitrary loudspeaker set-ups may be present and the decoder provides audio channels 32*a* to 32*e* to individual loudspeakers, which are optimally tailored to the reconstruction of the audio scene, as the full information on the audio scene is available on the decoder side. For example, binaural rendering is feasible, which results in two audio channels generated to provide a spatial impression when listened to via headphones.

An optional user interaction to the scene composer 30 enables a repositioning/repanning of the individual audio objects on the reproduction side. Additionally, positions or levels of specifically selected audio objects can be modified, to, for example, increase the intelligibility of a talker, when ambient noise objects or other audio objects related to different talkers in a conference are suppressed, i.e. decreased in level.

In other words, conventional audio object coders encode a number of audio objects into elementary streams, each stream associated to one single audio object. The conventional decoder decodes these streams and composes an audio scene under the control of a scene description (BIFS) and optionally based on user interaction. In terms of practical application, this approach suffers from several disadvantages:

Due to the separate encoding of each individual audio (sound) object, the necessitated bitrate for transmission of the whole scene is significantly higher than rates used for a monophonic/stereophonic transmission of compressed audio. Obviously, the necessitated bitrate grows approximately proportionally with the number of transmitted audio objects, i.e. with the complexity of the audio scene.

Consequently, due to the separate decoding of each sound object, the computational complexity for the decoding process significantly exceeds that one of a regular mono/stereo audio decoder. The necessitated computational complexity for decoding grows approximately proportionally with the number of transmitted objects as well (assuming a low complexity composition procedure). When using advanced composition capabilities, i.e. using different computational nodes, these disadvantages are further increased by the complexity associated with the synchronization of corresponding audio nodes and with the overall complexity in running a structured audio engine.

Furthermore, since the total system involves several audio decoder components and a BIFS-based composition unit, the complexity of the necessitated structure is an obstacle to the implementation in real-world applications. Advanced composition capabilities furthermore necessitate the implementation of a structured audio engine with the above-mentioned complications.

Figure 2:
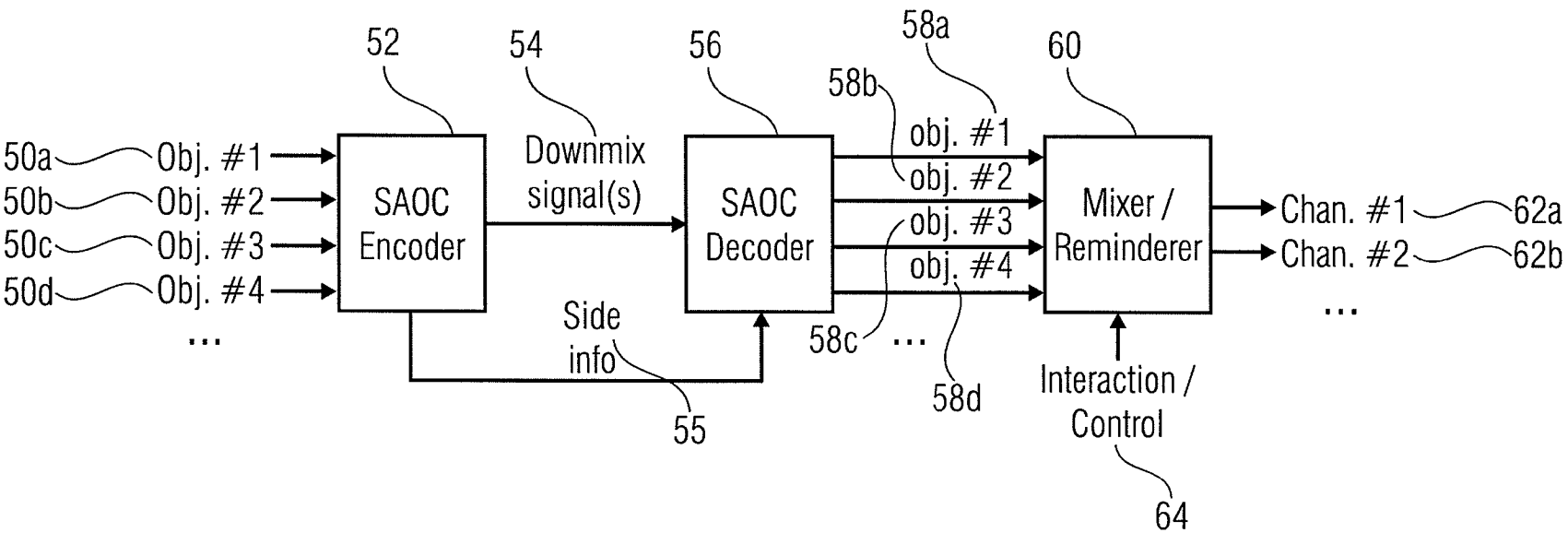
FIG. 2 shows a spatial audio object coding scheme.

FIG. 2 shows an embodiment of the inventive spatial audio object coding concept, allowing for a highly efficient audio object coding, circumventing the previously mentioned disadvantages of common implementations.

As it will become apparent from the discussion of FIG. 3 below, the concept may be implemented by modifying an existing MPEG Surround structure. However, the use of the MPEG Surround-framework is not mandatory, since other common multi-channel encoding/decoding frameworks can also be used to implement the inventive concept.

Utilizing existing multi-channel audio coding structures, such as MPEG Surround, the inventive concept evolves into a bitrate-efficient and compatible extension of existing audio distribution infrastructure towards the capability of using an object-based representation. To distinguish from the prior approaches of audio object coding (AOC) and spatial audio coding (multi-channel audio coding), embodiments of the present invention will in the following be referred to using the term spatial audio object coding or its abbreviation SAOC.

The spatial audio object coding scheme shown in FIG. 2 uses individual input audio objects 50*a* to 50*d*. Spatial audio object encoder 52 derives one or more down-mix signals 54 (e.g. mono or stereo signals) together with side information 55 having information of the properties of the original audio scene.

The SAOC-decoder 56 receives the down-mix signal 54 together with the side information 55. Based on the down-mix signal 54 and the side information 55, the spatial audio object decoder 56 reconstructs a set of audio objects 58*a* to 58*d*. Reconstructed audio objects 58*a* to 58*d* are input into a mixer/rendering stage 60, which mixes the audio content of the individual audio objects 58*a* to 58*d* to generate a desired number of output channels 62*a* and 62*b*, which normally correspond to a multi-channel loudspeaker set-up intended to be used for playback.

Optionally, the parameters of the mixer/renderer 60 can be influenced according to a user interaction or control 64, to allow interactive audio composition and thus maintain the high flexibility of audio object coding.

The concept of spatial audio object coding shown in FIG. 2 has several great advantages as compared to other multi-channel reconstruction scenarios.

The transmission is extremely bitrate-efficient due to the use of down-mix signals and accompanying object parameters. That is, object based side information is transmitted together with a down-mix signal, which is composed of audio signals associated to individual audio objects. Therefore, the bit rate demand is significantly decreased as compared to approaches, where the signal of each individual audio object is separately encoded and transmitted. Furthermore, the concept is backwards compatible to already existing transmission structures. Legacy devices would simply render (compose) the downmix signal.

The reconstructed audio objects 58*a* to 58*d* can be directly transferred to a mixer/renderer 60 (scene composer). In general, the reconstructed audio objects 58*a* to 58*d* could be connected to any external mixing device (mixer/renderer 60), such that the inventive concept can be easily implemented into already existing playback environments. The individual audio objects 58*a* . . . *d* could principally be used as a solo presentation, i.e. be reproduced as a single audio stream, although they are usually not intended to serve as a high quality solo reproduction.

In contrast to separate SAOC decoding and subsequent mixing, a combined SAOC-decoder and mixer/renderer is extremely attractive because it leads to very low implementation complexity. As compared to the straight forward approach, a full decoding/reconstruction of the objects 58*a* to 58*d* as an intermediate representation can be avoided. The computation is mainly related to the number of intended output rendering channels 62*a* and 62*b*. As it becomes apparent from FIG. 2, mixer/renderer 60 associated to the SAOC-decoder can in principle be any algorithm suitable of combining single audio objects into a scene, i.e. suitable of generating output audio channels 62*a* and 62*b* associated to individual loudspeakers of a multi-channel loudspeaker set-up. This could, for example, include mixers performing amplitude panning (or amplitude and delay panning), vector based amplitude panning (VBAP schemes) and binaural rendering, i.e. rendering intended to provide a spatial listening experience utilizing only two loudspeakers or headphones. For example, MPEG Surround employs such binaural rendering approaches.

Generally, transmitting down-mix signals 54 associated with corresponding audio object information 55 can be combined with arbitrary multi-channel audio coding techniques, such as, for example, parametric stereo, binaural cue coding or MPEG Surround.

Figure 3:
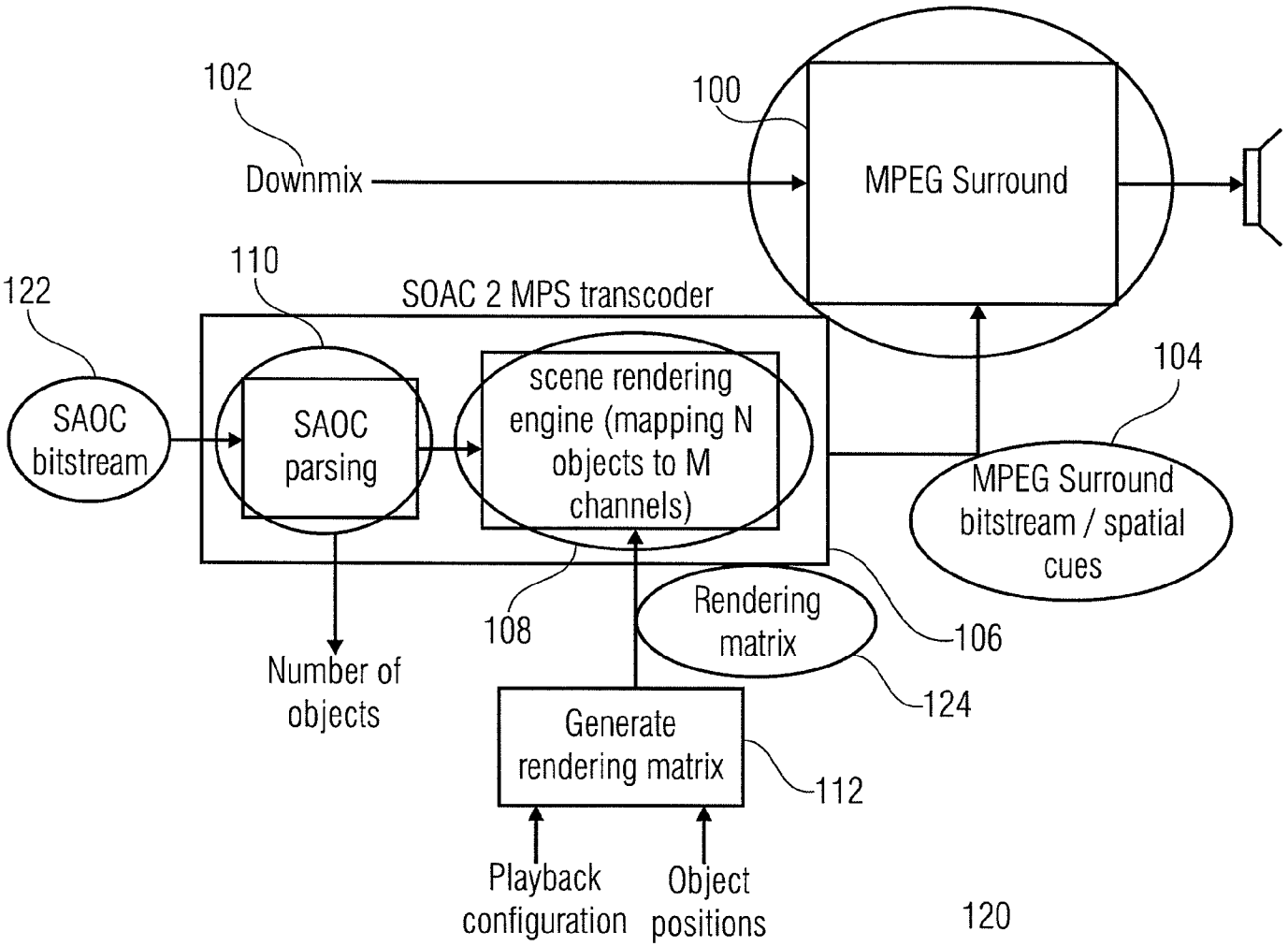
FIG. 3 shows an embodiment of a multi-channel parameter transformer.

FIG. 3 shows an embodiment of the present invention, in which object parameters are transmitted together with a down-mix signal. In the SAOC decoder structure 120, a MPEG Surround decoder can be used together with a multi-channel parameter transformer, which generates MPEG parameters using the received object parameters. This combination results in an spatial audio object decoder 120 with extremely low complexity. In other words, this particular example offers a method for transforming (spatial audio) object parameters and panning information associated with each audio object into a standards compliant MPEG Surround bitstream, thus extending the application of conventional MPEG Surround decoders from reproducing multi-channel audio content towards the interactive rendering of spatial audio object coding scenes. This is achieved without having to apply modifications to the MPEG Surround decoder itself.

Figure 4:
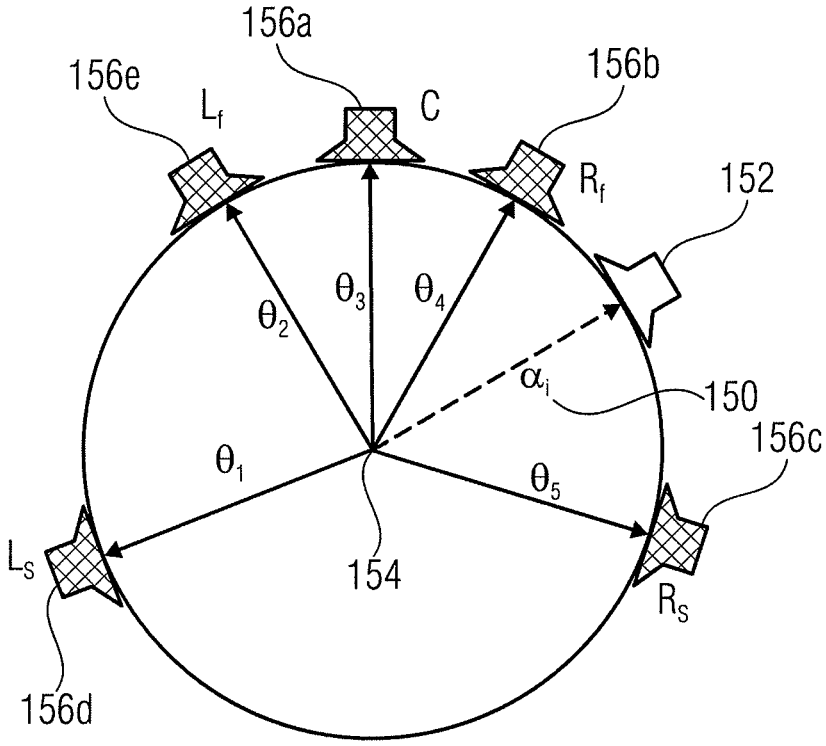
FIG. 4 shows an example for a multi-channel loudspeaker configuration for playback of spatial audio content.

The embodiment shown in FIG. 3 circumvents the drawbacks of conventional technology by using a multi-channel parameter transformer together with an MPEG Surround decoder. While the MPEG Surround decoder is commonly available technology, a multi-channel parameter transformer provides a transcoding capability from SAOC to MPEG Surround. These will be detailed in the following paragraphs, which will additionally make reference to FIGS. 4 and 5, illustrating certain aspects of the combined technologies.

In FIG. 3, an SAOC decoder 120 has an MPEG Surround decoder 100 which receives a down-mix signal 102 having the audio content. The downmix signal can be generated by an encoder-side downmixer by combining (e.g. adding) the audio object signals of each audio object in a sample by sample manner. Alternatively, the combining operation can also take place in a spectral domain or filterbank domain. The downmix channel can be separate from the parameter bitstream 122 or can be in the same bitstream as the parameter bitstream.

Figure 5:
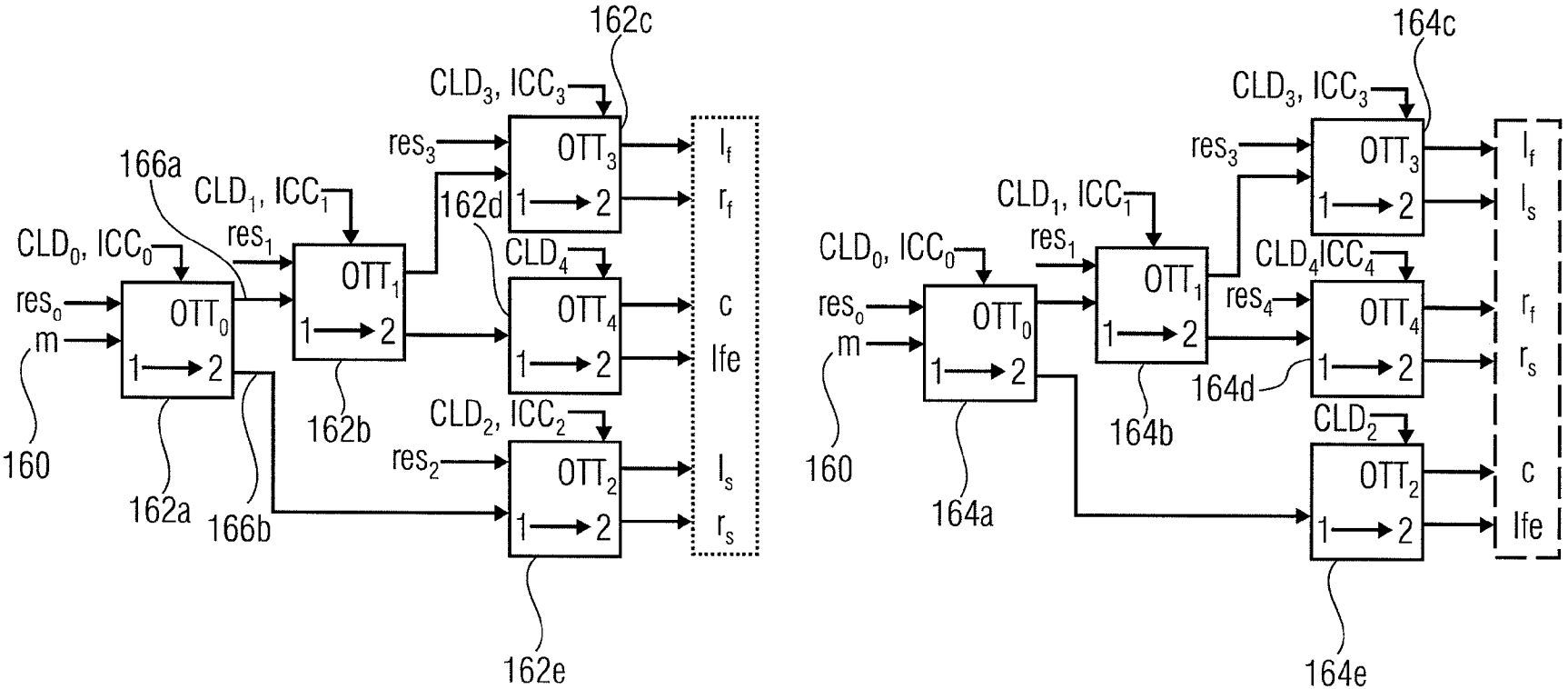
FIG. 5 shows an example for a possible multi-channel parameter representation of spatial audio content.

The MPEG Surround decoder 100 additionally receives spatial cues 104 of an MPEG Surround bitstream, such as coherence parameters ICC and level parameters CLD, both representing the signal characteristics between two audio signals within the MPEG Surround encoding/decoding scheme, which is shown in FIG. 5 and which will be explained in more detail below.

A multi-channel parameter transformer 106 receives SAOC parameters (object parameters) 122 related to audio objects, which indicate properties of associated audio objects contained within Downmix Signal 102. Furthermore, the transformer 106 receives object rendering parameters via an object rendering parameters input. These parameters can be the parameters of a rendering matrix or can be parameters useful for mapping audio objects into a rendering scenario.

Depending on the object positions exemplarily adjusted by the user and input into block 12, the rendering matrix will be calculated by block 112. The output of block 112 is then input into block 106 and particularly into the parameter generator 108 for calculating the spatial audio parameters. When the loudspeaker configuration changes, the rendering matrix or generally at least some of the object rendering parameters change as well. Thus, the rendering parameters depend on the rendering configuration, which comprises the loudspeaker configuration/playback configuration or the transmitted or user-selected object positions, both of which can be input into block 112.

A parameter generator 108 derives the MPEG Surround spatial cues 104 based on the object parameters, which are provided by object parameter provider (SAOC parser) 110. The parameter generator 108 additionally makes use of rendering parameters provided by a weighting factor generator 112. Some or all of the rendering parameters are weighting parameters describing the contribution of the audio objects contained in the down-mix signal 102 to the channels created by the spatial audio object decoder 120. The weighting parameters could, for example, be organized in a matrix, since these serve to map a number of N audio objects to a number M of audio channels, which are associated to individual loudspeakers of a multi-channel loudspeaker set-up used for playback. There are two types of input data to the multi-channel parameter transformer (SAOC 2 MPS transcoder). The first input is an SAOC bitstream 122 having object parameters associated to individual audio objects, which indicate spatial properties (e.g. energy information) of the audio objects associated to the transmitted multi-object audio scene. The second input is the rendering parameters (weighting parameters) 124 used for mapping the N objects to the M audio-channels.

As previously discussed, the SAOC bitstream 122 contains parametric information about the audio objects that have been mixed together to create the down-mix signal 102 input into the MPEG Surround decoder 100. The object parameters of the SAOC bitstream 122 are provided for at least one audio object associated to the down-mix channel 102, which was in turn generated using at least an object audio signal associated to the audio object. A suitable parameter is, for example, an energy parameter, indicating an energy of the object audio signal, i.e. the strength of the contribution of the object audio signal to the down-mix 102. In case a stereo downmix is used, a direction parameter might be provided, indicating the location of the audio object within the stereo downmix. However, other object parameters are obviously also suited and could therefore be used for the implementation.

The transmitted downmix does not have to be a monophonic signal. It could, for example, also be a stereo signal. In that case, 2 energy parameters might be transmitted as object parameters, each parameter indicating each object's contribution to one of the two channels of the stereo signal. That is, for example, if 20 audio objects are used for the generation of the stereo downmix signal, 40 energy parameters would be transmitted as the object parameters.

The SAOC bit stream 122 is fed into an SAOC parsing block, i.e. into object parameter provider 110, which regains the parametric information, the latter comprising, besides the actual number of audio objects dealt with, mainly object level envelope (OLE) parameters which describe the time-variant spectral envelopes of each of the audio objects present.

The SAOC parameters will typically be strongly time dependent, as they transport the information, as to how the multi-channel audio scene changes with time, for example when certain objects emanate or others leave the scene. To the contrary, the weighting parameters of rendering matrix 124 do often not have a strong time or frequency dependency. Of course, if objects enter or leave the scene, the number of necessitated parameters changes abruptly, to match the number of the audio objects of the scene. Furthermore, in applications with interactive user control, the matrix elements may be time variant, as they are then depending on the actual input of a user.

In a further embodiment of the present invention, parameters steering a variation of the weighting parameters or the object rendering parameters or time-varying object rendering parameters (weighting parameters) themselves may be conveyed in the SAOC bitstream, to cause a variation of rendering matrix 124. The weighting factors or the rendering matrix elements may be frequency dependent, if frequency dependent rendering properties are desired (as for example when a frequency-selective gain of a certain object is desired).

In the embodiment of FIG. 3, the rendering matrix is generated (calculated) by a weighting factor generator 112 (rendering matrix generation block) based on information about the playback configuration (that is a scene description). This might, on the one hand, be playback configuration information, as for example loudspeaker parameters indicating the location or the spatial positioning of the individual loudspeakers of a number of loudspeakers of the multi-channel loudspeaker configuration used for playback. The rendering matrix is furthermore calculated based on object rendering parameters, e.g. on information indicating the location of the audio objects and indicating an amplification or attenuation of the signal of the audio object. The object rendering parameters can, on the one hand, be provided within the SAOC bitstream if a realistic reproduction of the multi-channel audio scene is desired. The object rendering parameters (e.g. location parameters and amplification information (panning parameters)) can alternatively also be provided interactively via a user interface. Naturally, a desired rendering matrix, i.e. desired weighting parameters, can also be transmitted together with the objects to start with a naturally sounding reproduction of the audio scene as a starting point for interactive rendering on the decoder side.

The parameter generator (scene rendering engine) 108 receives both, the weighting factors and the object parameters (for example the energy parameter OLE) to calculate a mapping of the N audio objects to M output channels, wherein M may be larger than, less than or equal to N and furthermore even varying with time. When using a standard MPEG Surround decoder 100, the resulting spatial cues (for example, coherence and level parameters) may be transmitted to the MPEG-decoder 100 by means of a standards-compliant surround bitstream matching the down-mix signal transmitted together with the SAOC bitstream.

Using a multi-channel parameter transformer 106, as previously described, allows using a standard MPEG Surround decoder to process the down-mix signal and the transformed parameters provided by the parameter transformer 106 to play back the reconstruction of the audio scene via the given loudspeakers. This is achieved with the high flexibility of the audio object coding-approach, i.e. by allowing serious user interaction on the playback side.

As an alternative to the playback of a multi-channel loudspeaker set-up, a binaural decoding mode of the MPEG Surround decoder may be utilized to play back the signal via headphones.

However, if minor modifications to the MPEG Surround decoder 100 are acceptable, e.g. within a software-implementation, the transmission of the spatial cues to the MPEG Surround decoder could also be performed directly in the parameter domain. I.e., the computational effort of multiplexing the parameters into an MPEG Surround compatible bitstream can be omitted. Apart from the decrease in computational complexity, a further advantage is to avoid of a quality degradation introduced by the MPEG-conforming parameter quantization, since such quantization of the generated spatial cues would in this case no longer be necessitated. As already mentioned, this benefit calls for a more flexible MPEG Surround decoder implementation, offering the possibility of a direct parameter feed rather than a pure bitstream feed.

In another embodiment of the present invention, an MPEG Surround compatible bitstream is created by multiplexing the generated spatial cues and the down-mix signal, thus offering the possibility of a playback via legacy equipment. Multi-channel parameter transformer 106 could thus also serve the purpose of transforming audio object coded data into multi-channel coded data at the encoder side. Further embodiments of the present invention, based on the multi-channel parameter transformer of FIG. 3 will in the following be described for specific object audio and multi-channel implementations. Important aspects of those implementations are illustrated in FIGS. 4 and 5.

FIG. 4 illustrates an approach to implement amplitude panning, based on one particular implementation, using direction (location) parameters as object rendering parameters and energy parameters as object parameters. The object rendering parameters indicate the location of an audio object. In the following paragraphs, angles $\alpha_i$ 150 will be used as object rendering (location) parameters, which describe the direction of origin of an audio object 152 with respect to a listening position 154. In the following examples, a simplified two-dimensional case will be assumed, such that one single parameter, i.e. an angle, can be used to unambiguously parameterize the direction of origin of the audio signal associated with the audio object. However, it goes without saying, that the general three-dimensional case can be implemented without having to apply major changes. That is, having for exampled a three-dimensional space, vectors could be used to indicate the location of the audio objects within the spatial audio scene. As an MPEG Surround decoder shall in the following be used to implement the inventive concept, FIG. 4 additionally shows the loudspeaker locations of a five-channel MPEG multi-channel loudspeaker configuration. When the position of a centre loudspeaker 156*a*(C) is defined to be at 0°, a right front speaker 156*b* is located at 30°, a right surround speaker 156*c* is located at 110°, a left surround speaker 156*d* is located at −110° and a left front speaker 156*e* is located at −30°.

The following examples will furthermore be based on 5.1-channel representations of multi-channel audio signals as specified in the MPEG Surround standard, which defines two possible parameterisations, that can be visualized by the tree-structures shown in FIG. 5.

In case of the transmission of a mono-down-mix 160, the MPEG Surround decoder employs a tree-structure parameterization. The tree is populated by so-called OTT elements (boxes) 162*a* to 162*e* for the first parameterization and 164*a* to 164*e* for the second parameterization.

Each OTT element up-mixes a mono-input into two output audio signals. To perform the up-mix, each OTT element uses an ICC parameter describing the desired cross-correlation between the output signals and a CLD parameter describing the relative level differences between the two output signals of each OTT element.

Even though structurally similar, the two parameterizations of FIG. 5 differ in the way the audio-channel content is distributed from the monophonic down-mix 160. For example, in the left tree-structure, the first OTT element 162*a* generates a first output channel 166*a* and a second output channel 166*b*. According to the visualization in FIG. 5, the first output channel 166*a* comprises information on the audio channels of the left front, the right front, the centre and the low frequency enhancement channel. The second output signal 166*b* comprises only information on the surround channels, i.e. on the left surround and the right surround channel. When compared to the second implementation, the output of the first OTT element differs significantly with respect to the audio channels comprised.

However, a multi-channel parameter transformer can be implemented based on either of the two implementations. Once the inventive concept is understood, it may also be applied to other multi channel configurations than the ones described below. For the sake of conciseness, the following embodiments of the present invention focus on the left parameterization of FIG. 5, without loss of generality. It may furthermore be noted, that FIG. 5 only serves as an appropriate visualization of the MPEG-audio concept and that the computations are normally not performed in a sequential manner, as one might be tempted to believe by the visualizations of FIG. 5. Generally, the computations can be performed in parallel, i.e. the output channels can be derived in one single computational step.

In the embodiments briefly discussed in the following paragraphs, an SAOC bitstream comprises (relative) levels of each audio object in the down-mixed signal (for each time-frequency tile separately, as is common practice within a frequency-domain framework using, for example, a filter-bank or a time-to-frequency transformation).

Furthermore, the present invention is not limited to a specific level representation of the objects, the description below merely illustrates one method to calculate the spatial cues for the MPEG Surround bitstream based on an object power measure that can be derived from the SAOC object parameterization.

As is apparent from FIG. 3, the rendering matrix W, which is generated by weighting parameters and used by the parameter generator 108 to map the objects $o_i$ to the necessitated number of output channels (e.g. the number of loudspeakers) s, has a number of weighting parameters, which depends on the particular object index i and the channel index s. As such, a weighting parameter $w_{s,i}$ denotes the mixing gain of object i ($1 \le i \le N$) to loudspeaker s ($1 \le s \le M$). That is, W maps objects $o=[o_1 \ldots o_N]^T$ to loudspeakers, generating the output signals for each loudspeaker (here assuming a 5.1 set-up) $y=[y_{Lf}\, y_{Rf}\, y_C\, y_{LFE}\, y_{Ls}\, y_{Rs}]^T$, thus:

$$y=Wo.$$

The parameter generator (the rendering engine 108) utilizes the rendering matrix W to estimate all CLD and ICC parameters based on SAOC data $\sigma_i^2$. With respect to the visualizations of FIG. 5, it becomes apparent, that this process has to be performed for each OTT element independently. A detailed discussion will focus on the first OTT element 162*a*, since the teachings of the following paragraphs can be adapted to the remaining OTT elements without further inventive skill.

As it can be observed, the first output signal 166*a* of OTT element 162*a* is processed further by OTT elements 162*b*, 162*c* and 162*d*, finally resulting in output channels LF, RF, C and LFE. The second output channel 166*b* is processed further by OTT element 162*e*, resulting in output channels LS and RS. Substituting the OTT elements of FIG. 5 with one single rendering matrix W can be performed by using the following matrix W:

$$W = \begin{bmatrix} w_{Lf,1} & \dots & w_{Lf,N} \\ w_{Rf,1} & \dots & w_{Rf,N} \\ w_{C,1} & \dots & w_{C,N} \\ w_{LFE,1} & \dots & w_{LFE,N} \\ w_{Ls,1} & \dots & w_{Ls,N} \\ w_{Rs,1} & \dots & w_{Rs,N} \end{bmatrix}$$

The number N of the columns of matrix W is not fixed, as N is the number of audio objects, which might be varying.

One possibility to derive the spatial cues (CLD and ICC) for the OTT element 162*a* is that the respective contribution of each object to the two outputs of OTT element 0 is obtained by summation of the corresponding elements in W. This summation gives a sub-rendering matrix $W_0$ of OTT element 0:

$$W_0 = \begin{bmatrix} w_{1,1} & \dots & w_{1,N} \\ w_{2,1} & \dots & w_{2,N} \end{bmatrix} = \begin{bmatrix} w_{Lf,1} + w_{Rf,1} + w_{C,1} + w_{LFE,1} & \dots & w_{Lf,N} + w_{Rf,N} + w_{C,N} + w_{LFE,N} \\ w_{Ls,1} + w_{Rs,1} & \dots & w_{Ls,N} + w_{Rs,N} \end{bmatrix}$$

The problem is now simplified to estimating the level difference and correlation for sub-rendering matrix $W_0$ (and for similarly defined sub-rendering matrices $W_1$, $W_2$, $W_3$ and $W_4$ related to the OTT elements 1, 2, 3 and 4, respectively).

Assuming fully incoherent (i.e. mutually independent) object signals, the estimated power of the first output of OTT element 0, $p_{0,1}^2$, is given by:

$$p_{0,1}^2 = \sum_i w_{1,i}^2 \sigma_i^2.$$

Similarly, the estimated power of the second output of OTT element 0, $p_{0,2}^2$, is given by:

$$p_{0,2}^2 = \sum_i w_{2,i}^2 \sigma_i^2.$$

The cross-power $R_0$ is given by:

$$R_0 = \sum_i w_{1,i} w_{2,i} \sigma_i^2.$$

The CLD parameter for OTT element 0 is then given by:

$$CLD_0 = 10\log_{10}\left(\frac{p_{0,1}^2}{p_{0,2}^2}\right),$$

and the ICC parameter is given by:

$$ICC_0 = \left(\frac{R_0}{p_{0,1} p_{0,2}}\right).$$

When FIG. 5 left portion is considered, both signals for which $p_{0,1}$ and $p_{0,2}$ have been determined as shown above are virtual signals, since these signals represent a combination of loudspeaker signals and do not constitute actually occurring audio signals. At this point, it is emphasized that the tree structures in FIG. 5 are not used for generation of the signals. This means that in the MPEG surround decoder, any signals between the one-to-two boxes do not exist. Instead, there is a big upmix matrix using the donwnmix and the different parameters to more or less directly generate the loudspeaker signals.

Below, the grouping or identification of channels for the left configuration of FIG. 5 is described.

For box 162*a*, the first virtual signal is the signal representing a combination of the loudspeaker signals lf, rf, c, lfe. The second virtual signal is the virtual signal representing a combination of ls and rs.

For box 162*b*, the first audio signal is a virtual signal and represents a group including a left front channel and a right front channel, and the second audio signal is a virtual signal and represents a group including a center channel and an lfe channel.

For box 162*e*, the first audio signal is a loudspeaker signal for the left surround channel and the second audio signal is a loudspeaker signal for the right surround channel.

For box 162*c*, the first audio signal is a loudspeaker signal for the left front channel and the second audio signal is a loudspeaker signal for the right front channel.

For box 162*d*, the first audio signal is a loudspeaker signal for the center channel and the second audio signal is a loudspeaker signal for the low frequency enhancement channel.

In these boxes, the weighting parameters for the first audio signal or the second audio signal are derived by combining object rendering parameters associated to the channels represented by the first audio signal or the second audio signal as will be outlined later on.

Below, the grouping or identification of channels for the right configuration of FIG. 5 is described.

For box 164*a*, the first audio signal is a virtual signal and represents a group including a left front channel, a left surround channel, a right front channel, and a right surround channel, and the second audio signal is a virtual signal and represents a group including a center channel and a low frequency enhancement channel.

For box 164*b*, the first audio signal is a virtual signal and represents a group including a left front channel and a left surround channel, and the second audio signal is a virtual signal and represents a group including a right front channel and a right surround channel.

For box 164*e*, the first audio signal is a loudspeaker signal for the center channel and the second audio signal is a loudspeaker signal for the low frequency enhancement channel.

For box 164*c*, the first audio signal is a loudspeaker signal for the left front channel and the second audio signal is a loudspeaker signal for the left surround channel.

For box 164*d*, the first audio signal is a loudspeaker signal for the right front channel and the second audio signal is a loudspeaker signal for the right surround channel.

In these boxes, the weighting parameters for the first audio signal or the second audio signal are derived by combining object rendering parameters associated to the channels represented by the first audio signal or the second audio signal as will be outlined later on.

The above mentioned virtual signals are virtual, since they do not necessarily occur in an embodiment. These virtual signals are used to illustrate the generation of power values or the distribution of energy which is determined by CLD for all boxes e.g. by using different sub-rendering matrices $W_i$. Again, the left side of FIG. 5 is described first.

Above, the sub-rendering matrix $W_0$ for box 162*a* has been shown.

For box 162*b*, the sub-rendering matrix is defined as:

$$W_1 = \begin{bmatrix} w_{1,1} & \dots & w_{1,N} \\ w_{2,1} & \dots & w_{2,N} \end{bmatrix} = \begin{bmatrix} w_{lf,1} + w_{rf,1} & \dots & w_{lf,N} + w_{rf,N} \\ w_{c,1} + w_{lfe,1} & \dots & w_{c,N} + w_{lfe,N} \end{bmatrix}$$

For box 162*e*, the sub-rendering matrix is defined as:

$$W_2 = \begin{bmatrix} w_{1,1} & \dots & w_{1,N} \\ w_{2,1} & \dots & w_{2,N} \end{bmatrix} = \begin{bmatrix} w_{ls,1} & \dots & w_{ls,N} \\ w_{rs,1} & \dots & w_{rs,N} \end{bmatrix}$$

For box 162*c*, the sub-rendering matrix is defined as:

$$W_3 = \begin{bmatrix} w_{1,1} & \dots & w_{1,N} \\ w_{2,1} & \dots & w_{2,N} \end{bmatrix} = \begin{bmatrix} w_{lf,1} & \dots & w_{lf,N} \\ w_{rf,1} & \dots & w_{rs,N} \end{bmatrix}$$

For box 162*d*, the sub-rendering matrix is defined as:

$$W_4 = \begin{bmatrix} w_{1,1} & \dots & w_{1,N} \\ w_{2,1} & \dots & w_{2,N} \end{bmatrix} = \begin{bmatrix} w_{c,1} & \dots & w_{c,N} \\ w_{lfe,1} & \dots & w_{lfe,N} \end{bmatrix}$$

For the right configuration in FIG. 5, the situation is as follows:

For box 164*a*, the sub-rendering matrix is defined as:

$$W_0 = \begin{bmatrix} w_{1,1} & \dots & w_{1,N} \\ w_{2,1} & \dots & w_{2,N} \end{bmatrix} = \begin{bmatrix} w_{lf,1} + w_{ls,1} + w_{rf,1} + w_{rs,1} & \dots & w_{lf,N} + w_{ls,N} + w_{rf,N} + w_{rs,N} \\ w_{c,1} + w_{lfe,1} & \dots & w_{c,N} + w_{lfe,N} \end{bmatrix}$$

For box 164*b*, the sub-rendering matrix is defined as:

$$W_1 = \begin{bmatrix} w_{1,1} & \dots & w_{1,N} \\ w_{2,1} & \dots & w_{2,N} \end{bmatrix} = \begin{bmatrix} w_{lf,1} + w_{ls,1} & \dots & w_{lf,N} + w_{ls,N} \\ w_{rf,1} + w_{rs,1} & \dots & w_{rf,N} + w_{rs,N} \end{bmatrix}$$

For box 164*e*, the sub-rendering matrix is defined as:

$$W_2 = \begin{bmatrix} w_{1,1} & \dots & w_{1,N} \\ w_{2,1} & \dots & w_{2,N} \end{bmatrix} = \begin{bmatrix} w_{c,1} & \dots & w_{c,N} \\ w_{lfe,1} & \dots & w_{lfe,N} \end{bmatrix}$$

For box 164*c*, the sub-rendering matrix is defined as:

$$W_3 = \begin{bmatrix} w_{1,1} & \dots & w_{1,N} \\ w_{2,1} & \dots & w_{2,N} \end{bmatrix} = \begin{bmatrix} w_{lf,1} & \dots & w_{lf,N} \\ w_{ls,1} & \dots & w_{ls,N} \end{bmatrix}$$

For box 164*d*, the sub-rendering matrix is defined as:

$$W_4 = \begin{bmatrix} w_{1,1} & \dots & w_{1,N} \\ w_{2,1} & \dots & w_{2,N} \end{bmatrix} = \begin{bmatrix} w_{rf,1} & \dots & w_{rf,N} \\ w_{rs,1} & \dots & w_{rs,N} \end{bmatrix}$$

Depending on the implementation, the respective CLD and ICC parameter may be quantized and formatted to fit into an MPEG Surround bitstream, which could be fed into MPEG Surround decoder 100. Alternatively, the parameter values could be passed to the MPEG Surround decoder on a parameter level, i.e. without quantization and formatting into a bitstream. To not only achieve repanning of the objects, i.e. distributing these signal energies appropriately, which can be achieved using the above approach utilizing the MPEG-2 structure of FIG. 5, but to also implement attenuation or amplification, so-called arbitrary down-mix gains may also be generated for a modification of the down-mix signal energy. Arbitrary down-mix gains (ADG) allow for a spectral modification of the down-mix signal itself, before it is processed by one of the OTT elements. That is, arbitrary down-mix gains are per se frequency dependent. For an efficient implementation, arbitrary down-mix gains ADGs are represented with the same frequency resolution and the same quantizer steps as CLD-parameters. The general goal of the application of ADGs is to modify the transmitted down-mix in a way that the energy distribution in the down-mix input signal resembles the energy of the down-mix of the rendered system output. Using the weighting parameters $W_{k,i}$ of the rendering matrix W and the transmitted object powers $\sigma_i^2$ appropriate ADGs can be calculated using the following equation:

$$ADG[\text{dB}] = 10\log_{10}\left(\frac{\sum_k \sum_i w_{k,i}^2 \sigma_i^2}{\sum_i \sigma_i^2}\right),$$

and it is assumed, that the power of the input down-mix signal is equal to the sum of the object powers (i=object index, k=channel index).

As previously discussed, the computation of the CLD and ICC-parameters utilizes weighting parameters indicating a portion of the energy of the object audio signal associated to loudspeakers of the multi-channel loudspeaker configuration. These weighting factors will generally be dependent on scene data and playback configuration data, i.e. on the relative location of audio objects and loudspeakers of the multi-channel loudspeaker set-up. The following paragraphs will provide one possibility to derive the weighting parameters, based on the object audio parameterization introduced in FIG. 4, using an azimuth angle and a gain measure as object parameters associated to each audio object.

As already outlined above, there are independent rendering matrices for each time/frequency tile; however in the following only one single time/frequency tile is regarded for the sake of clarity. The rendering matrix W has got M lines (one for each output channel) and, N columns (one for each audio object) where the matrix element in line s and column i represents the mixing weight with which the particular audio object contributes to the respective output channel:

$$W = \begin{bmatrix} w_{1,1} & \cdots & w_{1,N} \\ \vdots & \ddots & \vdots \\ w_{M,1} & \cdots & w_{M,N} \end{bmatrix}$$

The matrix elements are calculated from the following scene description and loudspeaker configuration parameters: Scene description (these parameters can vary over time):

Number of audio objects: $N \geq 1$

Azimuth angle for each audio object: $\alpha_i$ $(1 \leq i \leq N)$

Gain value for each object: $g_i$ $(1 \leq i \leq N)$

Loudspeaker configuration (usually these parameters are time-invariant):

Number of output channels (=speakers): $M \geq 2$

Azimuth angle for each speaker: $\theta_s$ $(1 \leq s \leq M)$ $\theta_s \leq \theta_{s+1}$ $\forall$ s with $1 \leq s \leq M-1$ The elements of the mixing matrix are derived from these parameters by pursuing the following scheme for each audio object i:

Find index s' $(1 \leq s' \leq M)$ with $\theta_{s'} \leq \alpha_i \leq \theta_{s'+1}$ $(\theta_{M+1} := \theta_1 + 2\pi)$ Apply amplitude panning (e.g. tangent law) between speakers s' and s'+1 (between speakers M and 1 in case of s'=M). In the following description, the variables v are the panning weights, i.e. the scaling factors to be applied to a signal, when it is distributed between two channels, as for example illustrated in FIG. 4.:

$$\frac{\tan\left(\frac{1}{2}(\theta_{s'} + \theta_{s'+1}) - \alpha_i\right)}{\tan\left(\frac{1}{2}(\theta_{s'+1} - \theta_{s'})\right)} = \frac{v_{1,i} - v_{2,i}}{v_{1,i} + v_{2,i}}; \sqrt[p]{v_{1,i}^p + v_{2,i}^p} = 1;$$

$$1 \leq p \leq 2.$$

With respect to the above equations, it may be noted that in the two-dimensional case, an object audio signal associated to an audio object of the spatial audio scene will be distributed between the two speakers of the multi-channel loudspeaker configuration, which are closest to the audio object. However, the object parameters chosen for the above implementation are not the only object parameters which can be used to implement further embodiments of the present invention. For example, in a three-dimensional case, object parameters indicating the location of the loudspeakers or the audio objects may be three-dimensional vectors. Generally, two parameters are necessitated for the two-dimensional case and three parameters are necessitated for the three-dimensional case, when the location shall be unambiguously defined. However, even in the two-dimensional case, different parameterizations may be used, for example transmitting two coordinates within a rectangular coordinate system. It may furthermore be noted, that the optional panning rule parameter p, which is within a range of 1 to 2, is an arbitrary panning rule parameter, which is set to reflect room acoustic properties of a reproduction system/room, and which is, according to some embodiments of the present invention, additionally applicable. Finally, the weighting parameters $W_{s,i}$ can be derived according to the following formula, after the panning weights $V_{1,i}$ and $V_{2,i}$ have been derived according to the above equations. The matrix elements are finally given by the following equations:

$$w_{s,i} = \begin{cases} \sqrt{g_i} \cdot v_{1,i} & \text{for} \quad s = s' \\ \sqrt{g_i} \cdot v_{2,i} & \text{for} \quad s = s' + 1 \\ 0 & \text{otherwise} \end{cases}$$

The previously introduced gain factor $g_i$, which is optionally associated to each audio object, may be used to emphasize or suppress individual objects. This may, for example, be performed on the receiving side, i.e. in the decoder, to improve the intelligibility of individually chosen audio objects.

The following example of audio object 152 of FIG. 4 shall again serve to clarify the application of the above equations. The example utilizes the ITU-R BS.775-1 conforming 3/2-channel setup previously described. It is the aim to derive the desired panning direction of an audio object i, characterized by an azimuthal angle $\alpha_i$=60°, with an arbitrary panning gain $g_i$ of 1, (i.e. 0 dB). With this example, the playback room shall exhibit some reverberation, parameterized by the panning rule parameter p=2. According to FIG. 4, it is apparent that the closest loudspeakers are the right front loudspeaker 156*b* and the right surround loudspeaker 156*c*. Therefore, the panning weights can be found by solving the following equations:

$$\frac{\tan 10°}{\tan 40°} = \frac{v_{1,i} - v_{2,i}}{v_{1,i} + v_{2,i}}; \sqrt{v_{1,i}^2 + v_{2,i}^2} = 1.$$

After some mathematics, this leads to the solution:

$$v_{1,i} \approx 0.8374; v_{2,i} \approx 0.5466.$$

Therefore, according to the above instructions, the weighting parameters (matrix elements) associated to the specific audio object located in direction $\alpha_i$ are derived to be:

$$w1 = w2 = w3 = 0; w4 = 0.8374; w5 = 0.5466.$$

The above paragraphs detail embodiments of the present invention utilizing only audio objects, which can be represented by a monophonic signal, i.e. point-like sources. However, the flexible concept is not restricted to the application with monophonic audio sources. To the contrary, one or more objects, which are to be regarded as spatially "diffuse" do also fit well into the inventive concept. Multi-channel parameters have to be derived in an appropriate manner, when non point-like sources or audio objects are to be represented. An appropriate measure to quantify an amount of diffuseness between one or more audio objects, is an object-related cross-correlation parameter ICC.

In the SAOC system discussed so far all audio objects were supposed to be point sources, i.e. pair-wise uncorrelated mono sound sources without any spatial extent. However there are also application scenarios in which it is desirable to allow audio objects that comprise more than only one audio channel, exhibiting to a certain degree pair-wise (de)correlation. The simplest and probably most important case out of these is represented by stereo objects, i.e. objects consisting of two more or less correlated channels that belong together. As an example, such an object could represent the spatial image produced by a symphony orchestra.

In order to smoothly integrate stereo objects into a mono audio object based system as it is described above, both channels of a stereo object are treated as individual objects. The interrelationship of both part objects is reflected by an additional cross-correlation parameter which is calculated based on the same time/frequency grid as is applied for the derivation of the sub-band power values $\sigma_i^2$. In other words: A stereo object is defined by a set of parameter triplets $\{\sigma_i^2, \sigma_j^2, ICC_{i,j}\}$ per time/frequency tile, where $ICC_{i,j}$ denotes the pair-wise correlation between the two realizations of one object. These two realizations are denoted by individual objects i and j. having a pair-wise correlation $ICC_{i,j}$.

For the correct rendering of stereo objects an SAOC decoder provides means for establishing the correct correlation between those playback channels that participate in the rendering of the stereo object, such that the contribution of that stereo object to the respective channels exhibits a correlation as claimed by the corresponding $ICC_{i,j}$ parameter. An SAOC to MPEG Surround transcoder which is capable of handling stereo objects, in turn, derives ICC parameters for the OTT boxes that are involved in reproducing the related playback signals, such that the amount of decorrelation between the output channels of the MPEG Surround decoder fulfills this condition.

In order to do so, compared to the example given in the previous section of this document, the calculation of the powers $p_{0,1}$ and $p_{0,2}$ and the cross-power $R_0$ have to be changed. Assuming the indices of the two audio objects that together build a stereo object to be $i_1$ and $i_2$ the formulas change in the following manner:

$$R_0 = \sum_i \left( \sum_j ICC_{i,j} \cdot w_{1,i} w_{2,j} \sigma_i \sigma_j \right),$$

$$p_{0,1}^2 = \sum_i \left( \sum_j w_{1,i} w_{1,j} \sigma_i \sigma_j ICC_{i,j} \right),$$

$$p_{0,2}^2 = \sum_i \left( \sum_j w_{2,i} w_{2,j} \sigma_i \sigma_j ICC_{i,j} \right).$$

It can be observed easily that in case of $ICC_{i_1,i_2}=0 \ \forall \ i_1 \neq i_2$ and $ICC_{i_1,i_2}=1$ otherwise, these equations are identical to those given in the previous section.

Having the capability of using stereo objects has the obvious advantage, that the reproduction quality of the spatial audio scene can be significantly enhanced, when audio sources other than point sources can be treated appropriately. Furthermore, the generation of a spatial audio scene may be performed more efficiently, when one has the capability of using premixed stereo signals, which are widely available for a great number of audio objects.

The following considerations will furthermore show that the inventive concept allows for the integration of point-like sources, which have an "inherent" diffuseness. Instead of objects representing point sources, as in the previous examples, one or more objects may also be regarded as spatially 'diffuse'. The amount of diffuseness can be characterized by an object-related cross-correlation parameter $ICC_{i,j}$. For $ICC_{i,j}=1$, the object i represents a point source, while for $ICC_{i,i}=0$, the object is maximally diffuse. The object-dependent diffuseness can be integrated in the equations given above by filling in the correct $ICC_{i,j}$ values.

When stereo objects are utilized, the derivation of the weighting factors of the matrix M has to be adapted. However, the adaptation can be performed without inventive skill, as for the handling of stereo objects, two azimuth positions (representing the azimuth values of the left and the right "edge" of the stereo object) are converted into rendering matrix elements.

As already mentioned, regardless of the type of audio objects used, the rendering Matrix elements are generally defined individually for different time/frequency tiles and do in general differ from each other. A variation over time may, for example, reflect a user interaction, through which the panning angles and gain values for every individual object may be arbitrarily altered over time. A variation over frequency allows for different features influencing the spatial perception of the audio scene, as, for example, equalization.

Implementing the inventive concept using a multi-channel parameter transformer allows for a number of completely new, previously not feasible, applications. As, in a general, sense, the functionality of SAOC can be characterized as efficient coding and interactive rendering of audio objects, numerous applications requiring interactive audio can benefit from the inventive concept, i.e. the implementation of an inventive multi-channel parameter transformer or an inventive method for a multi-channel parameter transformation.

As an example, completely new interactive teleconferencing scenarios become feasible. Current telecommunication infrastructures (telephone, teleconferencing etc.) are monophonic. That is, classical object audio coding cannot be applied, since this necessitates the transmission of one elementary stream per audio object to be transmitted. However, these conventional transmission channels can be extended in their functionality by introducing SAOC with a single down-mix channel. Telecommunication terminals equipped with an SAOC extension, that is mainly with a multi-channel parameter transformer or an inventive object parameter transcoder, are able to pick up several sound sources (objects) and mix them into a single monophonic down-mix signal which is transmitted in a compatible way by using the existing coders (for example speech coders). The side information (spatial audio object parameters or object parameters) may be conveyed in a hidden, backwards compatible way. While such advanced terminals produce an output object stream containing several audio objects, the legacy terminals will reproduce the downmix signal. Conversely, the output produced by legacy terminals (i.e. a downmix signal only) will be considered by SAOC transcoders as a single audio object.

Figure 6A:
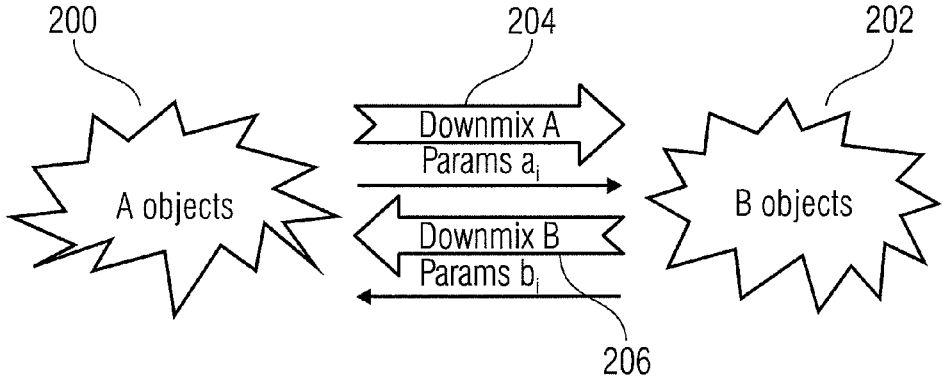
FIGS. 6*a* and 6*b* show application scenarios for spatial audio object coded content.

The principle is illustrated in FIG. 6*a*. At a first teleconferencing site 200, A objects (talkers) may be present, whereas at a second teleconferencing site 202 B objects (talkers) may be present. According to SAOC, object parameters can be transmitted from the first teleconferencing site 200 together with an associated down-mix signal 204, whereas a down-mix signal 206 can be transmitted from the second teleconferencing site 202 to the first teleconferencing site 200, associated by audio object parameters for each of the B objects at the second teleconferencing site 202. This has the tremendous advantage, that the output of multiple talkers can be transmitted using only one single down-mix channel and that furthermore, additional talkers may be emphasized at the receiving site, as the additional audio object parameters, associated to the individual talkers, are transmitted in association with the down-mix signal.

This allows, for example, a user to emphasize one specific talker of interest by applying object-related gain values $g_i$, thus making the remaining talkers nearly inaudible. This would not be possible when using conventional multi-channel audio techniques, since these would try to reproduce the original spatial audio scene as naturally as possible, without the possibility of allowing a user interaction to emphasize selected audio objects.

Figure 6B:
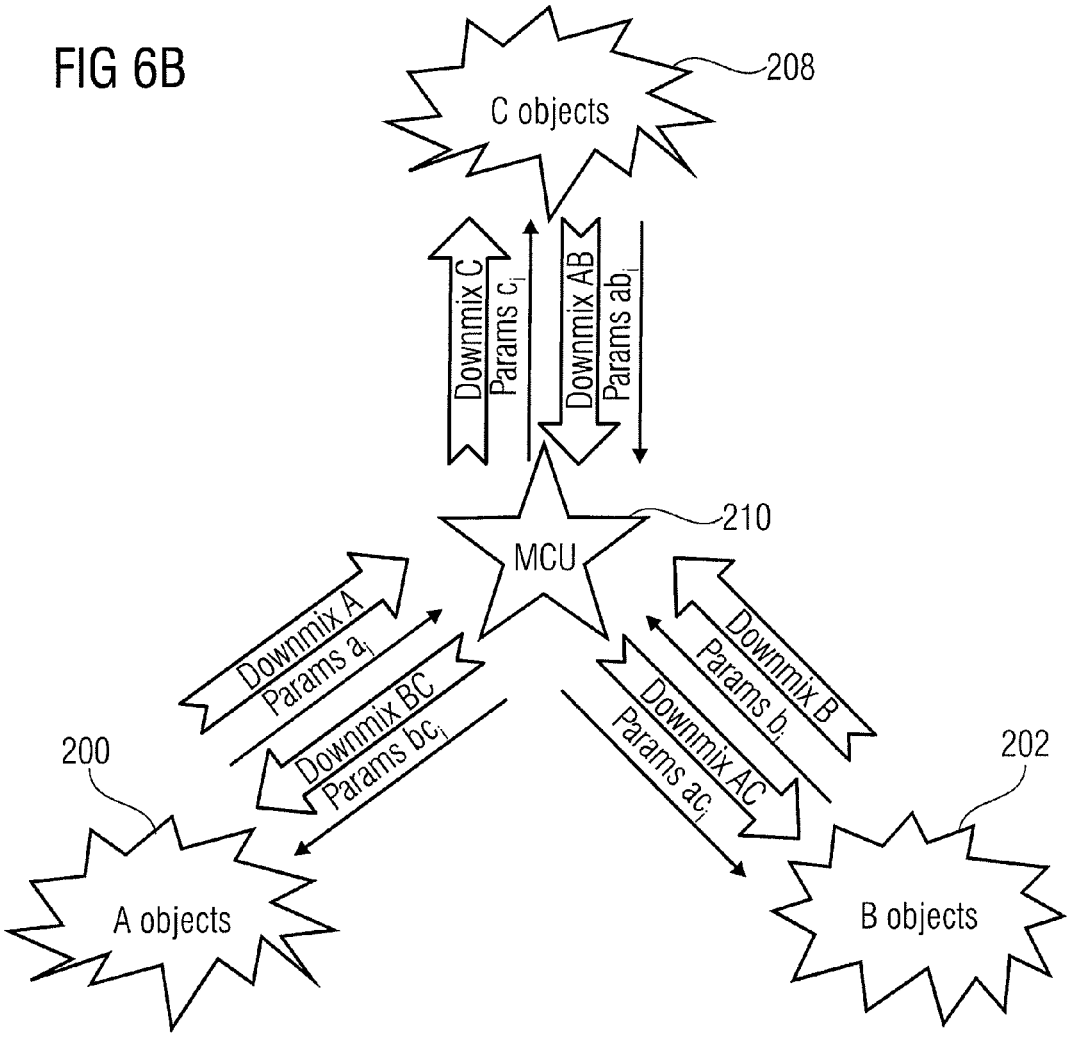

FIG. 6*b* illustrates a more complex scenario, in which teleconferencing is performed among three teleconferencing sites 200, 202 and 208. Since each site is only capable of receiving and sending one audio signal, the infrastructure uses so-called multi-point control units MCU 210. Each site 200, 202 and 208 is connected to the MCU 210. From each site to the MCU 210, a single upstream contains the signal from the site. The downstream for each site is a mix of the signals of all other sites, possibly excluding the site's own signal (the so-called "N-1 signal").

According to the previously discussed concept and the inventive parameter transcoders, the SAOC bitstream format supports the ability to combine two or more object streams, i.e. two streams having a down-mix channel and associated audio object parameters into a single stream in a computationally efficient way, i.e. in a way not requiring a preceding full reconstruction of the spatial audio scene of the sending site. Such a combination is supported without decoding/re-encoding of the objects according to the present invention. Such a spatial audio object coding scenario is particularly attractive when using low delay MPEG communication coders, such as, for example low delay AAC.

Another field of interest for the inventive concept is interactive audio for gaming and the like. Due to its low computational complexity and independency from a particular rendering set-up, SAOC is ideally suited to represent sound for interactive audio, such as gaming applications. The audio could furthermore be rendered depending on the capabilities of the output terminal. As an example, a user/player could directly influence the rendering/mixing of the current audio scene. Moving around in a virtual scene is reflected by an adaptation of the rendering parameters. Using a flexible set of SAOC sequences/bitstreams would enable the reproduction of a non-linear game story controlled by user interaction.

According to a further embodiment of the present invention, inventive SAOC coding is applied within a multi-player game, in which a user interacts with other players in the same virtual world/scene. For each user, the video and audio scene is based on his position and orientation in the virtual world and rendered accordingly on his local terminal. General game parameters and specific user data (position, individual audio; chat etc.) is exchanged between the different players using a common game server. With legacy techniques, every individual audio source not available by default on each client gaming device (particularly user chat, special audio effects) in a game scene has to be encoded and sent to each player of the game scene as an individual audio stream. Using SAOC, the relevant audio stream for each player can easily be composed/combined on the game server, be transmitted as a single audio stream to the player (containing all relevant objects) and rendered at the correct spatial position for each audio object (=other game players' audio).

According to a further embodiment of the present invention, SAOC is used to play back object soundtracks with a control similar to that of a multi-channel mixing desk using the possibility to adjust relative level, spatial position and audibility of instruments according to the listener's liking. Such, a user can:

- suppress/attenuate certain instruments for playing along (Karaoke type of applications)
- modify the original mix to reflect their preference (e.g. more drums and less strings for a dance party or less drums and more vocals for relaxation music)
- choose between different vocal tracks (female lead vocal via male lead vocal) according to their preference.

As the above examples have shown, the application of the inventive concept opens the field for a wide variety of new, previously unfeasible applications. These applications become possible, when using an inventive multi-channel parameter transformer of FIG. 7 or when implementing a method for generating a coherence parameter indicating a correlation between a first and a second audio signal and a level parameter, as shown in FIG. 8.

Figure 7:
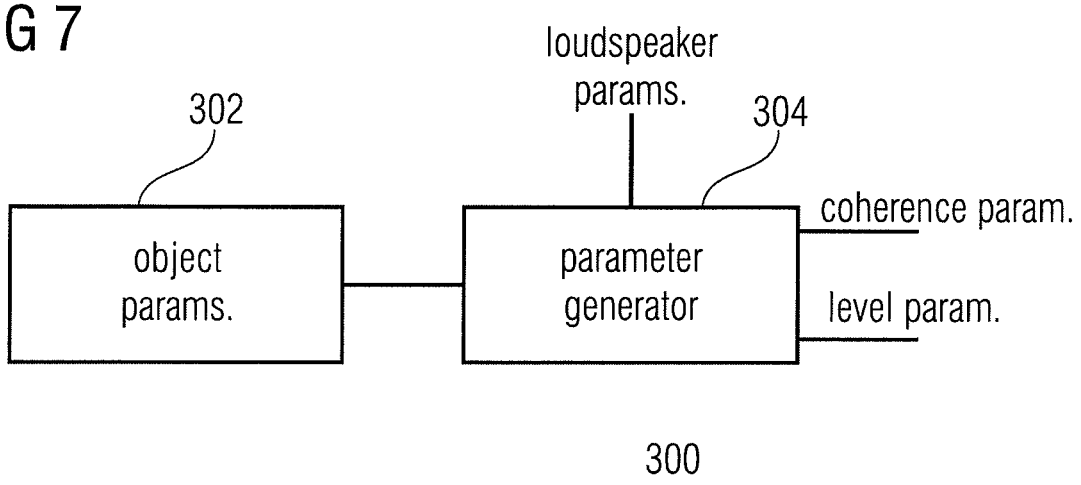
FIG. 7 shows an embodiment of a multi-channel parameter transformer.

FIG. 7 shows a further embodiment of the present invention. The multi-channel parameter transformer 300 comprises an object parameter provider 302 for providing object parameters for at least one audio object associated to a down-mix channel generated using an object audio signal which is associated to the audio object. The multi-channel parameter transformer 300 furthermore comprises a parameter generator 304 for deriving a coherence parameter and a level parameter, the coherence parameter indicating a correlation between a first and a second audio signal of a representation of a multi-channel audio signal associated to a multi-channel loudspeaker configuration and the level parameter indicating an energy relation between the audio signals. The multi-channel parameters are generated using the object parameters and additional loudspeaker parameters, indicating a location of loudspeakers of the multi-channel loudspeaker configuration to be used for playback.

Figure 8:
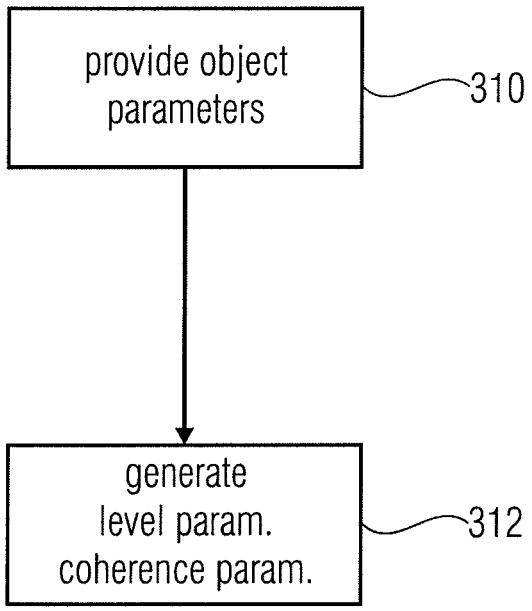
FIG. 8 shows an example of a method for generating a coherence parameter and a correlation parameter.

FIG. 8 shows an example of the implementation of an inventive method for generating a coherence parameter indicating a correlation between a first and a second audio signal of a representation of a multi-channel audio signal associated to a multi-channel loudspeaker configuration and for generating a level parameter indicating an energy relation between the audio signals. In a providing step 310, object parameters for at least one audio object associated to a down-mix channel generated using an object audio signal associated to the audio object, the object parameters comprising a direction parameter indicating the location of the audio object and an energy parameter indicating an energy of the object audio signal are provided.

In a transformation step 312, the coherence parameter and the level parameter are derived combining the direction parameter and the energy parameter with additional loudspeaker parameters indicating a location of loudspeakers of the multi-channel loudspeaker configuration intended to be used for playback.

Further embodiments comprise an object parameter transcoder for generating a coherence parameter indicating a correlation between two audio signals of a representation of a multi-channel audio signal associated to a multi-channel loudspeaker configuration and for generating a level parameter indicating an energy relation between the two audio signals based on a spatial audio object coded bit stream. This device includes a bit stream decomposer for extracting a down-mix channel and associated object parameters from the spatial audio object coded bit stream and a multi-channel parameter transformer as described before.

Alternatively or additionally, the object parameter transcoder comprises a multi-channel bit stream generator for combining the down-mix channel, the coherence parameter and the level parameter to derive the multi-channel representation of the multi-channel signal or an output interface for directly outputting the level parameter and the coherence parameter without any quantization and/or entropy encoding.

Another object parameter transcoder has an output interface is further operative to output the down mix channel in association with the coherence parameter and the level parameter or has a storage interface connected to the output interface for storing the level parameter and the coherence parameter on a storage medium.

Furthermore, the object parameter transcoder has a multi-channel parameter transformer as described before, which is operative to derive multiple coherence parameter and level parameter pairs for different pairs of audio signals representing different loudspeakers of the multi-channel loudspeaker configuration.

Depending on certain implementation requirements of the inventive methods, the inventive methods can be implemented in hardware or in software. The implementation can be performed using a digital storage medium, in particular a disk, DVD or a CD having electronically readable control signals stored thereon, which cooperate with a programmable computer system such that the inventive methods are performed. Generally, the present invention is, therefore, a computer program product with a program code stored on a machine readable carrier, the program code being operative for performing the inventive methods when the computer program product runs on a computer. In other words, the inventive methods are, therefore, a computer program having a program code for performing at least one of the inventive methods when the computer program runs on a computer.

While the foregoing has been particularly shown and described with reference to particular embodiments thereof, it will be understood by those skilled in the art that various other changes in the form and details may be made without departing from the spirit and scope thereof. It is to be understood that various changes may be made in adapting to different embodiments without departing from the broader concepts disclosed herein and comprehended by the claims that follow.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

What is claimed is:

1. Multi-channel parameter transformer for generating a level parameter indicating an energy relation between a first audio signal and a second audio signal of a representation of a multi-channel spatial audio signal, comprising:

an object parameter provider for providing object parameters for a plurality of audio objects associated to a down-mix channel depending on object audio signals associated to the audio objects, the object parameters comprising an energy parameter for each audio object indicating an energy information of the object audio signal; and a parameter generator for deriving the level parameter by combining the energy parameters and object rendering parameters related to a rendering configuration, wherein the parameter generator is additionally adapted to derive a coherence parameter based on the object rendering parameters and the energy parameter, the coherence parameter indicating a correlation between the first audio signal and the second audio signal, wherein the object parameter provider is adapted to provide parameters for a stereo object, the stereo object having a first stereo sub-object and a second stereo sub-object, the energy parameters having a first energy parameter $\sigma_i^2$ for the first sub-object of the stereo audio object, a second energy parameter $\sigma_j^2$ for the second sub-object of the stereo audio object and a stereo correlation parameter $ICC_{i,j}$, the stereo correlation parameter indicating a correlation between the sub-objects of the stereo object;

wherein the parameter generator is adapted to use first and second weighting parameters as object rendering parameters, which indicate a portion of the energy of the object audio signal to be distributed to a first and a second loudspeaker of the multi-channel loudspeaker configuration, the first and second weighting parameters depending on loudspeaker parameters indicating a location of loudspeakers of the multi-channel loudspeaker configuration, the first and second weighting parameters comprising $w_{1,i}$ and $w_{2,i}$ which indicate a portion of the energy of the object audio signal of the first sub-object to be distributed to a first and a second loudspeaker of the multi-channel loudspeaker configuration, respectively, and $w_{1,j}$ and $w_{2,j}$ which indicate a portion of the energy of the object audio signal of the second sub-object to be distributed to the first and the second loudspeaker of the multi-channel loudspeaker configuration, respectively, wherein the parameter generator is operative to derive the level parameter and the coherence parameter based on a power estimation $p_{0,1}$ associated to the first audio signal and a power estimation $p_{0,2}$ associated to the second audio signal and a cross power correlation $R_0$, using the first energy parameter $\sigma_i^2$, the second energy parameter $\sigma_j^2$, and the stereo correlation parameter $ICC_{i,j}$ first and second weighting parameters $w_{1,j}$, $w_{2,j}$, $w_{1,j}$ and $w_{2,j}$ such, that the power estimations and the cross power correlation can be characterized by the following equations:

$$R_0 = \sum_i \left( \sum_j ICC_{i,j} \cdot w_{1,i} w_{2,j} \sigma_i \sigma_j \right),$$

$$p_{0,1}^2 = \sum_i \left( \sum_j w_{1,i} w_{1,j} \sigma_i \sigma_j ICC_{i,j} \right),$$

$$p_{0,2}^2 = \sum_i \left( \sum_j w_{2,i} w_{2,j} \sigma_i \sigma_j ICC_{i,j} \right).$$

2. Multi-channel parameter transformer in accordance with claim 1, in which the object rendering parameters depend on object location parameters indicating a location of the audio object.

3. Multi-channel parameter transformer in accordance with claim 1, in which the rendering configuration comprises a multi-channel loudspeaker configuration, and in which the object rendering parameters depend on loudspeaker parameters indicating locations of loudspeakers of the multi-channel loudspeaker configuration.

4. Multi-channel parameter transformer in accordance with claim 1, in which the object parameter provider is operative to provide object parameters additionally comprising a direction parameter indicating a location of the object with respect to a listening position; and in which the parameter generator is operative to use object rendering parameters depending on loudspeaker parameters indicating locations of loudspeakers with respect to the listening position and on the direction parameter.

5. Multi-channel parameter transformer in accordance with claim 4, in which the object parameter provider and the parameter generator are operative to use a direction parameter indicating an angle within a reference plane, the reference plane comprising the listening position and also comprising the loudspeakers having locations indicated by the loudspeaker parameters.

6. Multi-channel parameter transformer in accordance with claim 1, in which the object parameter provider is operative to receive user input object parameters additionally comprising a direction parameter indicating a user-selected location of the object with respect to a listening position within the loudspeaker configuration; and in which the parameter generator is operative to use the object rendering parameters depending on loudspeaker parameters indicating locations of loudspeakers with respect to the listening position and on the user input direction parameter.

7. Multi-channel parameter transformer in accordance with claim 1, in which the parameter generator is adapted such that the first and second weighting parameters depend on the loudspeaker parameters indicating the location of the loudspeakers of the multi-channel loudspeaker configuration such that the weighting parameters are unequal to zero when the loudspeaker parameters indicate that the first and the second loudspeakers are among the loudspeakers having minimum distance with respect to a location of the audio object.

8. Multi-channel parameter transformer in accordance with claim 7, in which the parameter generator is adapted to use weighting parameters indicating a greater portion of the energy of the audio signal for the first, loudspeaker when the loudspeaker parameters indicate a lower distance between the first loudspeaker and the location of the audio object than between the second loudspeaker and the location of the audio object.

9. Multi-channel parameter transformer in accordance with claim 7, in which the parameter generator comprises:

a weighting factor generator for providing the first and the second weighting parameters $w_1$ and $w_2$ depending on loudspeaker parameters $\Theta_1$ and $\Theta_2$ for the first and second loudspeakers and on a direction parameter $\alpha$ of the audio object, wherein the loudspeaker parameters $\Theta_1$, $\Theta_2$ and the direction parameter $\alpha$ indicate a direction of the location of the loudspeakers and of the audio object with respect to a listening position.

10. Multi-channel parameter transformer in accordance with claim 9, in which the weighting factor generator is operative to provide the weighting parameters $w_1$ and $w_2$ such that the following equations are satisfied:

$$\frac{\tan\left(\frac{1}{2}(\Theta_1+\Theta_2)\right)-\alpha}{\tan\left(\frac{1}{2}(\Theta_2-\Theta_1)\right)}=\frac{w_1-w_2}{w_1+w_2};\text{ and}$$

$$\sqrt[p]{w_1^p+w_2^p}=1;\text{ wherein}$$

p is an optional panning rule parameter which is set to reflect room acoustic properties of a reproduction system/room, and is defined as $1 \leq p \leq 2$.

11. Multi-channel parameter transformer in accordance with claim 9, in which the weighting factor generator is operative to additionally scale the weighting parameters by applying a common multiplicative gain value associated to the audio object.

12. Multi-channel parameter transformer in accordance with claim 7, in which the object parameter provider is adapted to provide parameters for a stereo object, the stereo object having a first stereo sub-object and a second stereo sub-object, the energy parameters having a first energy parameter $\sigma_i^2$ for the first sub-object of the stereo audio object, a second energy parameter $\sigma_j^2$ for the second sub-object of the stereo audio object and a stereo correlation parameter $ICC_{i,j}$, the stereo correlation parameter indicating a correlation between the sub-objects of the stereo object;

in which the parameter generator is operative to derive the coherence parameter or the level parameter by additionally using the second energy parameter and the stereo correlation parameter.

13. Multichannel parameter transformer in accordance with claim 1, in which the parameter generator is operative to derive the level parameter or the coherence parameter based on a first power estimate $p_{k,1}$ associated to a first audio signal, wherein the first audio signal being intended for a loudspeaker or being a virtual signal representing a group of loudspeaker signals and on a second power estimate $p_{k,2}$ associated to a second audio signal, the second audio signal being intended for a different loudspeaker or being a virtual signal representing a different group of loudspeaker signals, wherein the first power estimate $p_{k,1}$ of the first audio signal depends on the energy parameters and weighting parameters associated to the first audio signal, and wherein the second power estimate $p_{k,2}$ associated to the second audio signal depends on the energy parameters and weighting parameters associated to the second audio signal, wherein k is an integer indicating a pair of a plurality of pairs of different first and second signals, and wherein the weighting parameters depend on the object rendering parameters.

14. Multi-channel parameter transformer in accordance with claim 13, in which the parameter generator is operative to calculate the level parameter or the coherence parameter for k pairs of different first and second audio signals, and in which the first, and second power estimates $p_{k,1}$ and $p_{k,2}$ associated to the first and second audio signals are based on the following equations, depending on the energy parameters $\sigma_i^2$, on weighting parameters $w_{1,i}$ associated to the first audio signal and on weighting parameters $w_{2,i}$ associated to the second audio signal:

$$p_{k,1}=\sum_i w_{1,i}^2\sigma_i^2$$

$$p_{k,2}=\sum_i w_{2,i}^2\sigma_i^2,$$

wherein i is an index indicating an audio object of the plurality of audio objects, and wherein k is an integer indicating a pair of a plurality of pairs of different first and second signals.

15. Multi-channel parameter transformer in accordance with claim 14, in which k is equal to zero, in which the first audio signal is a virtual signal and represents a group including a left front channel, a right, front channel, a center channel and an lfe channel, and in which the second audio signal is a virtual signal and represents a group including a left surround channel and a right surround channel, or in which k is equal to one, in which the first audio signal is a virtual signal and represents a group including a left front channel and a right front channel, and in which the second audio signal is a virtual signal and represents a group including a center channel and an lfe channel, or in which k is equal to two, in which the first audio signal is a loudspeaker signal for the left surround channel and in which the second audio signal is a loudspeaker signal for the right surround channel, or in which k is equal to three, in which the first audio signal is a loudspeaker signal for the left front channel and in which the second audio signal is a loudspeaker signal for the right front channel, or in which k is equal to four, in which the first audio signal is a loudspeaker signal for the center channel and in which the second audio signal is a loudspeaker signal for the low frequency enhancement channel, and wherein the weighting parameters for the first audio signal or the second audio signal are derived by combining object rendering parameters associated to the channels represented by the first audio signal or the second audio signal.

16. Multi-channel parameter transformer in accordance with claim 14, in which k is equal to zero, in which the first audio signal is a virtual signal and represents a group including a left front channel, a left surround channel, a right front channel, and a right surround channel, and in which the second audio signal is a virtual signal and represents a group including a center channel and a low frequency enhancement channel, or in which k is equal to one, in which the first audio signal is a virtual signal and represents a group including a left front channel and a left surround channel, and in which the second audio signal is a virtual signal and represents a group including a right front channel and a right surround channel, or in which k is equal to two, in which the first audio signal is a loudspeaker signal for the center channel and in which, the second audio signal is a loudspeaker signal for the low frequency enhancement channel, or in which k is equal to three, in which the first, audio signal is a loudspeaker signal for the left front channel and in which the second audio signal is a loudspeaker signal for the left surround channel, or in which k is equal to four, in which the first audio signal is a loudspeaker signal for the right front channel and in which the second audio signal is a loudspeaker signal for the right surround channel, and wherein the weighting parameters for the first audio signal or the second audio signal are derived by combining object rendering parameters associated to the channels represented by the first audio signal or the second audio signal.

17. Multi-Channel parameter transformer in accordance with claim 13, in which the parameter generator is adapted to derive the level parameter $CLD_k$ based on the following equation:

$$CLD_k = 10\log_{10}\left(\frac{p_{k,1}^2}{p_{k,2}^2}\right).$$

18. Multi-channel parameter transformer in accordance with claim 13, in which the parameter generator is adapted to derive the coherence parameter based on a cross power estimation $R_k$ associated to the first and the second audio signals depending on the energy parameters $\sigma_i^2$ and on the weighting parameters $w_1$ associated to the first audio signal and the weighting parameters $w_2$ associated to the second audio signal, wherein i is an index indicating an audio object of the plurality of audio objects.

19. Multi-channel parameter transformer in accordance with claim 18, in which the parameter generator is adapted to use or derive the cross power estimation $R_k$ based on the following equation:

$$R_k = \sum_i w_{1,i} w_{2,i} \sigma_i^2.$$

20. Multi-channel parameter transformer in accordance with claim 18, in which the parameter generator is operative to derive the coherence parameter ICC based on the following equation:

$$ICC_k = \frac{R_k}{p_{k,1} p_{k,2}}.$$

21. Multi-channel parameter transformer in accordance with claim 1, in which the parameter provider is adapted to provide, for each audio object and for each or a plurality of frequency bands, an energy parameter, and wherein the parameter generator is operative calculate the level parameter or the coherence parameter for each of the frequency bands.

22. Multi-channel parameter transformer in accordance with claim 1, in which the parameter generator is operative to use different object rendering parameters for different time-portions of the object audio signal.

23. Multi-channel parameter transformer for generating a level parameter indicating an energy relation between a first audio signal and a second audio signal of a representation of a multi-channel spatial audio signal comprising:

an object parameter provider for providing object parameters for a plurality of audio objects associated to a down-mix channel depending on the object audio signals associated to the audio objects, the object parameters comprising an energy parameter for each audio object indicating an energy information of the object audio signal; and a parameter generator for deriving the level parameter by combining the energy parameters and object rendering parameters related to a rendering configuration, wherein the parameter generator is adapted to use first and second weighting parameters as object rendering parameters, which indicate a portion of the energy of the object audio signal to be distributed to a first and a second loudspeaker of the multi-channel loudspeaker configuration, the first and second weighting parameters depending on loudspeaker parameters indicating a location of loudspeakers of the multi-channel loudspeaker configuration such that the weighting parameters are unequal to zero when the loudspeaker parameters indicate that the first and the second loudspeakers are among the loudspeakers having minimum distance with respect to a location of the audio object, wherein the weighting factor generator is operative to derive, for each audio object i, the weighting factors $w_{r,i}$ for the r-th loudspeaker depending on object direction parameters $\alpha_i$ and loudspeaker parameters $\Theta_r$ based on the following equations:

for an index $s'(1 \le s' \le M)$ with $$\theta_{s'} \le \alpha_i \le \theta_{s'+1}(\theta_{M+1} := \theta_1 + 2\pi)$$

$$\frac{\tan\left(\frac{1}{2}(\theta_{s'} + \theta_{s'+1}) - \alpha\right)}{\tan\left(\frac{1}{2}(\theta_{s'+1} - \theta_{s'})\right)} = \frac{v_{1,i} - v_{2,i}}{v_{1,i} + v_{2,i}}; \sqrt[p]{v_{1,i}^p + v_{2,i}^p} = 1; 1 \le p \le 2$$

$$w_{r,i} = \begin{cases} \sqrt{g_i} \cdot v_{1,i} & \text{for } s = s' \\ \sqrt{g_i} \cdot v_{2,i} & \text{for } s = s' + 1 \\ 0 & \text{otherwise.} \end{cases}$$

24. Method for generating a level parameter indicating an energy relation between a first audio signal and a second audio signal of a representation of a multi-channel spatial audio signal, comprising:

providing object parameters for a plurality of audio objects associated to a down-mix channel depending on object audio signals associated to the audio objects, the object parameters comprising an energy parameter for each audio object indicating an energy information of the object audio signal;

deriving the level parameter by combining the energy parameters and object rendering parameters related to a rendering configuration; and deriving a coherence parameter based on the object rendering parameters and the energy parameter, the coherence parameter indicating a correlation between the first audio signal and the second audio signal, wherein the provision of the object parameters comprises providing parameters for a stereo object, the stereo object having a first stereo sub-object and a second stereo sub-object, the energy parameters having a first energy parameter $\sigma_i^2$ for the first sub-object of the stereo audio object, a second energy parameter $\sigma_j^2$ for the second sub-object of the stereo audio object and a stereo correlation parameter $ICC_{i,j}$, the stereo correlation parameter indicating a correlation between the sub-objects of the stereo object;

wherein the derivation of the level and coherence parameters uses first and second weighting parameters as object rendering parameters, which indicate a portion of the energy of the object audio signal to be distributed to a first and a second loudspeaker of the multi-channel loudspeaker configuration, the first and second weighting parameters depending on loudspeaker parameters indicating a location of loudspeakers of the multi-channel loudspeaker configuration, the first and second weighting parameters comprising $w_{1,i}$ and $w_{2,i}$ which indicate a portion of the energy of the object audio signal of the first sub-object to be distributed to a first and a second loudspeaker of the multi-channel loudspeaker configuration, respectively, and $w_{1,j}$ and $w_{2,j}$ which indicate a portion of the energy of the object audio signal of the second sub-object to be distributed to the first and the second loudspeaker of the multi-channel loudspeaker configuration, respectively, and wherein the derivation of the level parameter is performed such that the level parameter and the coherence parameter is derived based on a power estimation $p_{0,1}$ associated to the first audio signal and a power estimation $p_{0,2}$ associated to the second audio signal and a cross power correlation $R_0$, using the first energy parameter $\sigma_i^2$, the second energy parameter $\sigma_j^2$, the stereo correlation parameter $ICC_{i,j}$ and the first and second weighting parameters $w_{1,i}$, $w_{2,i}$, $w_{1,j}$ and $w_{2,j}$ such, that the power estimations and the cross power correlation can be characterized by the following equations:

$$R_0 = \sum_i \left( \sum_j ICC_{i,j} \cdot w_{1,i} w_{2,j} \sigma_i \sigma_j \right),$$

$$p_{0,1}^2 = \sum_i \left( \sum_j w_{1,i} w_{1,j} \sigma_i \sigma_j ICC_{i,j} \right),$$

$$p_{0,2}^2 = \sum_i \left( \sum_j w_{2,i} w_{2,j} \sigma_i \sigma_j ICC_{i,j} \right).$$

25. Non-transitory computer readable medium having stored thereon a computer program having a program code for performing, when running on a computer, a method for generating a level parameter indicating an energy relation between a first audio signal and a second audio signal of a representation of a multi-channel spatial audio signal, comprising:

providing object parameters for a plurality of audio objects associated to a down-mix channel depending on object audio signals associated to the audio objects, the object parameters comprising an energy parameter for each audio object indicating an energy information of the object audio signal;

deriving the level parameter by combining the energy parameters and object rendering parameters related to a rendering configuration; and deriving a coherence parameter based on the object rendering parameters and the energy parameter, the coherence parameter indicating a correlation between the first audio signal and the second audio signal, wherein the provision of the object parameters comprises providing parameters for a stereo object, the stereo object having a first stereo sub-object and a second stereo sub-object, the energy parameters having a first energy parameter $\sigma_i^2$ for the sub-object of the stereo audio object, a second energy parameter $\sigma_j^2$ for the second sub-object of the stereo audio object and a stereo correlation parameter $ICC_{i,j}$, the stereo correlation parameter indicating a correlation between the sub-objects of the stereo object;

wherein the derivation of the level and coherence parameters uses first and second weighting parameters as object rendering parameters, which indicate a portion of the energy of the object audio signal to be distributed to a first and a second loudspeaker of the multi-channel loudspeaker configuration, the first and second weighting parameters depending on loudspeaker parameters indicating a location of loudspeakers of the multi-channel loudspeaker configuration, the first and second weighting parameters comprising $w_{1,i}$ and $w_{2,i}$ which indicate a portion of the energy of the object audio signal of the first sub-object to be distributed to a first and a second loudspeaker of the multi-channel loudspeaker configuration, respectively, and $w_{1,j}$ and $w_{2,j}$ which indicate a portion of the energy of the object audio signal of the second sub-object to be distributed to the first and the second loudspeaker of the multi-channel loudspeaker configuration, respectively, and wherein the derivation of the level parameter is performed such that the level parameter and the coherence parameter is derived based on power estimation $p_{0,1}$ associated to the first audio signal and a power estimation $p_{0,2}$ associated to the second audio signal and a cross power correlation $R_0$, using the first energy parameter $\sigma_i^2$, the second energy parameter $\sigma_j^2$, the stereo correlation parameter $ICC_{i,j}$ and the first and second weighting parameters $w_{1,i}$, $w_{2,j}$, $w_{1,j}$ and $w_{2,i}$ such, that the power estimations and the cross correlation estimation can be characterized by the following equations:

$$R_0 = \sum_i \left( \sum_j ICC_{i,j} \cdot w_{1,i} w_{2,j} \sigma_i \sigma_j \right),$$

$$p_{0,1}^2 = \sum_i \left( \sum_j w_{1,i} w_{1,j} \sigma_i \sigma_j ICC_{i,j} \right),$$

$$p_{0,2}^2 = \sum_i \left( \sum_j w_{2,i} w_{2,j} \sigma_i \sigma_j ICC_{i,j} \right).$$

26. Multi-channel parameter transformer, comprising:

an object parameter provider for providing object parameters for a plurality of audio objects associated to a down-mix channel depending on object audio signals associated to the audio objects, the object parameters comprising an energy parameter $\sigma_i^2$ for each audio object i indicating an energy information of the object audio signal, the audio objects i comprising a first and a second channel of a stereo object with the object parameters comprising, besides the energy parameters $\sigma_{i_1}^2$ and $\sigma_{i_2}^2$ for the first and second channels of the stereo object, a cross-correlation parameter $ICC_{i_1,i_2}$ indicating a correlation between the channels of the stereo object;

a weighting factor generator configured to generate, as object rendering parameters related to a rendering configuration, weighting parameters $w_{s,i}$ describing a contribution of the audio objects i to audio signals s of a representation of a multi-channel spatial audio signal, the audio signals comprising a first audio signal with s=1 and a second audio signal with s=2; and a parameter generator for deriving a level parameter indicating an energy relation between the first audio signal and the second audio signal and a coherence parameter indicating a correlation between the first audio signal and the second audio signal by combining the energy parameters and the object rendering parameters via a computation of a first power estimate $p_{0,1}$ for the first audio signal, a second power estimate $p_{0,2}$ for the second audio signal and a cross power correlation $R_0$ according to $$R_0 = \sum_i \left( \sum_j ICC_{i,j} \cdot w_{1,i} w_{2,j} \sigma_i \sigma_j \right),$$

$$p_{0,1}^2 = \sum_i \left( \sum_j w_{1,i} w_{1,j} \sigma_i \sigma_j ICC_{i,j} \right),$$

$$p_{0,2}^2 = \sum_i \left( \sum_j w_{2,i} w_{2,j} \sigma_i \sigma_j ICC_{i,j} \right).$$

* * * * *

UNITED STATES PATENT AND TRADEMARK OFFICE

CERTIFICATE OF CORRECTION

PATENT NO. : 8,687,829 B2
APPLICATION NO. : 12/445699
DATED : April 1, 2014
INVENTOR(S) : Johannes Hilpert et al.

It is certified that error appears in the above-identified patent and that said Letters Patent is hereby corrected as shown below:

On the Title page, in item (73), in column 1, under "Assignee", lines 2 and 3, delete "der Angewandten Forschung E.V." and insert -- der angewandten Forschung e.V., --, In the Claims In column 24, line 26, in claim 1, delete "$w_{1,j}$, $w_{2,j}$, $w_{1,j}$ and $w_{2,j}$," and insert -- $w_{1,i}$, $w_{2,i}$, $w_{1,j}$ and $w_{2,j}$ --, In column 25, line 26, in claim 8, delete "first, loudspeaker" and insert -- first loudspeaker --, In column 26, line 31, in claim 14, delete "first, and second" and insert -- first and second --, In column 26, line 51, in claim 15, delete "a right, front" and insert -- a right front --, In column 27, line 27, in claim 16, delete "and in which," and insert -- and in which --, In column 27, line 31, in claim 16, delete "the first, audio" and insert -- the first audio --, In column 27, line 46, in claim 17, delete "Multi-Channel" and insert -- Multi-channel --, In column 30, line 1, in claim 24, delete "$w_{1,j}$, $w_{2,j}$, $w_{1,j}$ and $w_{2,j}$," and insert -- $w_{1,i}$, $w_{2,i}$, $w_{1,j}$ and $w_{2,j}$ --, In column 30, line 40, in claim 25, delete "for the sub-object" and insert -- for the first sub-object --, In column 30, line 66, in claim 25, delete "based on power estimation" and insert -- based on a power estimation --.

Signed and Sealed this
Second Day of June, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,687,829 B2
APPLICATION NO. : 12/445699
DATED : April 1, 2014
INVENTOR(S) : Hilpert et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1324 days.

Signed and Sealed this
Twenty-ninth Day of September, 2015

Michelle K. Lee

Michelle K. Lee
*Director of the United States Patent and Trademark Office*